US012454837B2

(12) United States Patent
Machida

(10) Patent No.: US 12,454,837 B2
(45) Date of Patent: Oct. 28, 2025

(54) REBAR TYING TOOL AND REEL

(71) Applicant: MAKITA CORPORATION, Anjo (JP)

(72) Inventor: Yoshitaka Machida, Anjo (JP)

(73) Assignee: MAKITA CORPORATION, Anjo (JP)

( * ) Notice: Subject to any disclaimer, the term of this patent is extended or adjusted under 35 U.S.C. 154(b) by 479 days.

(21) Appl. No.: 17/987,313

(22) Filed: Nov. 15, 2022

(65) Prior Publication Data

US 2023/0160223 A1 May 25, 2023

(30) Foreign Application Priority Data

Nov. 19, 2021 (JP) ..... 2021-188815

(51) Int. Cl.
*E04G 21/12* (2006.01)

(52) U.S. Cl.
CPC ..... *E04G 21/123* (2013.01)

(58) Field of Classification Search
CPC ..... B21F 15/00; B21F 15/02; B21F 15/04; B65B 13/22; B65B 13/28; B65B 13/285; B65B 13/025; B65B 13/04; B65B 13/06; B65B 27/10; B25B 25/00; E04G 21/123
See application file for complete search history.

(56) References Cited

U.S. PATENT DOCUMENTS

2005/0061389 A1* 3/2005 Nakagawa ..... E04G 21/122 140/119
2006/0283516 A1* 12/2006 Nagaoka ..... E04G 21/122 140/119
2008/0134908 A1* 6/2008 Nagaoka ..... B65B 13/185 100/2
2009/0283167 A1* 11/2009 Nakagawa ..... B65H 51/30 100/2
2018/0170708 A1* 6/2018 Kasahara ..... B65H 75/14
2019/0194958 A1* 6/2019 Machida ..... E04G 21/123
2020/0047930 A1* 2/2020 Matsuno ..... B65H 75/14
2020/0165829 A1 5/2020 Geuvers et al.
(Continued)

FOREIGN PATENT DOCUMENTS

JP 2017-24908 A 2/2017
JP 2017-025586 A 2/2017
(Continued)

OTHER PUBLICATIONS

Apr. 1, 2025 Office Action issued in Japanese Patent Application No. 2021-188815.

*Primary Examiner* — Bobby Yeonjin Kim
(74) *Attorney, Agent, or Firm* — Oliff PLC

(57) ABSTRACT

A rebar tying tool may include: a reel including a bobbin and a wire wound around the bobbin, wherein the bobbin includes a detection target portion; a reel attaching part to which the reel is rotatably attached; a feeding unit configured to feed the wire from the bobbin around rebars; a twisting unit configured to twist the wire around the rebars; a plurality of detectors configured to detect the detection target portion; and a support supporting the reel attaching part, the feeding unit, the twisting unit, and the plurality of detectors. The plurality of detectors may be disposed along a rotation direction of the reel and configured to detect the detection target portion as the reel rotates.

19 Claims, 31 Drawing Sheets

(56) References Cited

U.S. PATENT DOCUMENTS

| | | | |
|---|---|---|---|
| 2020/0255255 | A1 | 8/2020 | Kasahara |
| 2020/0317465 | A1 | 10/2020 | Kasahara |
| 2020/0385991 | A1 | 12/2020 | Matsuno et al. |

FOREIGN PATENT DOCUMENTS

| | | | |
|---|---|---|---|
| JP | 2018-111960 | A | 7/2018 |
| JP | 2020-023831 | A | 2/2020 |

* cited by examiner

REBAR TYING TOOL AND REEL

CROSS-REFERENCE TO RELATED APPLICATION

This application claims priority to Japanese Patent Application No. 2021-188815, filed on Nov. 19, 2021, the entire contents of which are hereby incorporated by reference into the present application.

TECHNICAL FIELD

The disclosure herewith relates to rebar tying tools and reels.

BACKGROUND

Japanese Patent Application Publication No. 2017-24908 describes a rebar tying tool. The rebar tying tool includes a reel having a bobbin and a wire wound around the bobbin, wherein the bobbin includes a detection target portion; a reel attaching part to which the reel is rotatably attached; a feeding unit configured to feed the wire from the bobbin around rebars; a twisting unit configured to twist the wire around the rebars; a photointerrupter configured to detect the detection target portion; and a support supporting the reel attaching part, the feeding unit, the twisting unit, and the photointerrupter. The detection target portion is an annular rib arranged about a center axis of the bobbin. The photointerrupter is configured to detect the annular rib as the reel rotates.

SUMMARY

According to rebar tying tools such as the one above, the photointerrupter cannot detect the annular rib unless the reel rotates once. Thus, specific information of the reel cannot be detected unless the reel rotates once. The disclosure herein provides a technology that enables detection of specific information of a reel before the reel finishes rotating once.

A rebar tying tool disclosed herein may comprise: a reel comprising a bobbin and a wire wound around the bobbin, wherein the bobbin comprises a detection target portion; a reel attaching part to which the reel is rotatably attached; a feeding unit configured to feed the wire from the bobbin around rebars; a twisting unit configured to twist the wire around the rebars; a plurality of detectors configured to detect the detection target portion; and a support supporting the reel attaching part, the feeding unit, the twisting unit, and the plurality of detectors. The plurality of detectors may be disposed along a rotation direction of the reel and configured to detect the detection target portion as the reel rotates.

According to the configuration above, the plurality of detectors is disposed along the rotation direction of the reel, and thus the detection target portion can be detected before the reel finishes rotating once. Thus, specific information of the reel can be detected before the reel finishes rotating once.

A rebar tying tool disclosed herein may comprise: a reel attaching part to which a reel is rotatably attached, wherein the reel comprises a bobbin including a detection target portion and a wire wound around the bobbin; a feeding unit configured to feed the wire from the bobbin around rebars; a twisting unit configured to twist the wire around the rebars; a plurality of detectors configured to detect the detection target portion; and a support supporting the reel attaching part, the feeding unit, the twisting unit, and the plurality of detectors. The plurality of detectors may be disposed along a rotation direction of the reel and configured to detect the detection target portion as the reel rotates.

The configuration above can achieve the same effects as those of the rebar tying tool above.

A reel disclosed herein may be used by being rotatably attached to a reel attaching part of a rebar tying tool. The reel may comprise: a bobbin comprising a detection target portion; and a wire wound around the bobbin. The rebar tying tool may comprise a plurality of detectors disposed along a rotation direction of the reel. The detection target portion may include type information that indicates a type of the reel. The detection target portion may be detected by the plurality of detectors as the reel rotates.

According to the configuration above, the plurality of detectors is disposed along the rotation direction of the reel, and as such, after the reel is attached to the reel attaching part of the rebar tying tool, the detection target portion is detected before the reel finishes rotating once. Thus, the configuration can cause the rebar tying tool to detect specific information of the reel before the reel finishes rotating once.

DETAILED DESCRIPTION

Figure 1:
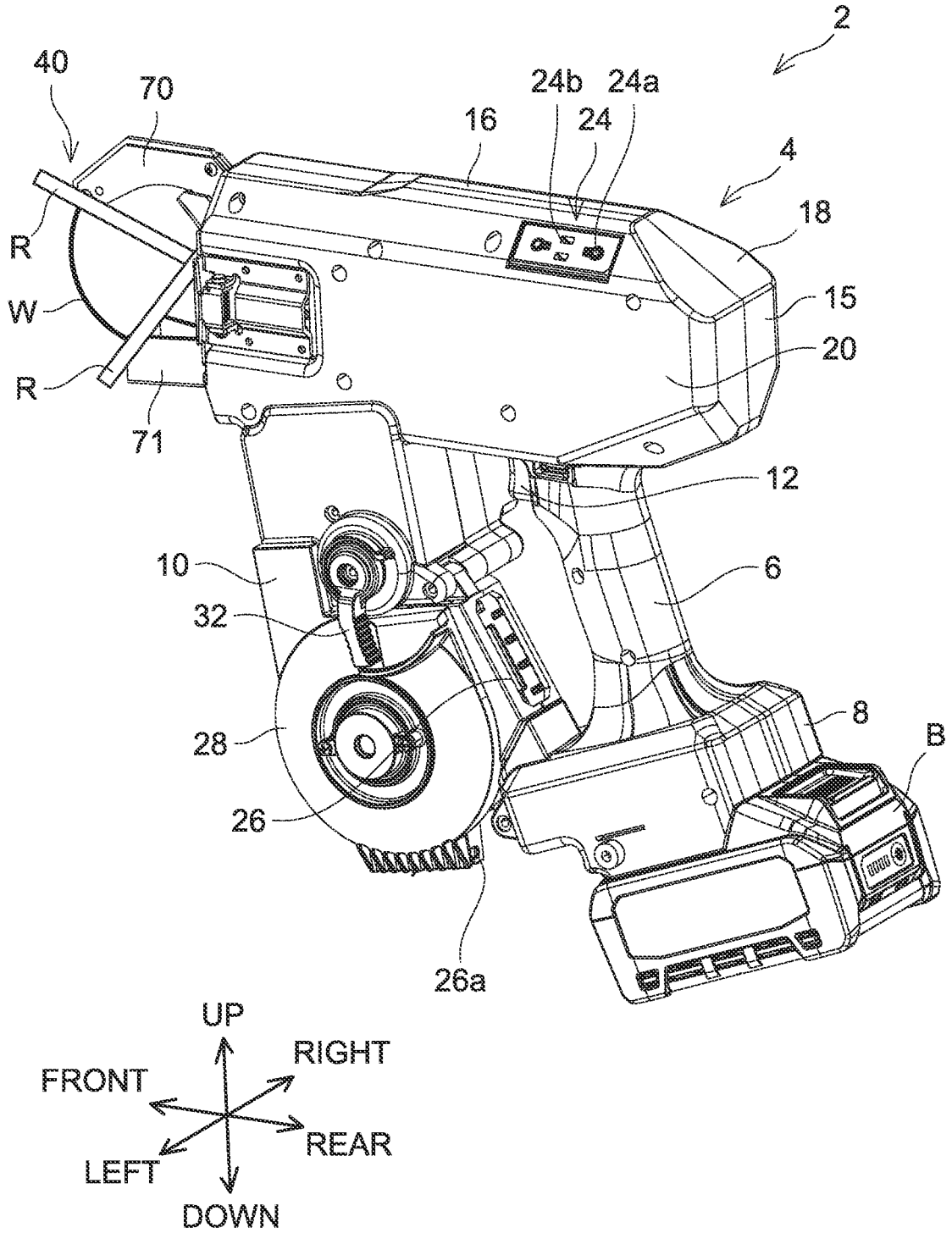
FIG. 1 is a perspective view of a rebar tying tool 2 according to a first embodiment, as viewed from the upper left rear side.

Representative, non-limiting examples of the present disclosure will now be described in further detail with reference to the attached drawings. This detailed description is merely intended to teach a person of skill in the art further details for practicing preferred aspects of the present teachings and is not intended to limit the scope of the present disclosure. Furthermore, each of the additional features and teachings disclosed below may be utilized separately or in conjunction with other features and teachings to provide improved rebar tying tools and reels, as well as methods for using and manufacturing the same.

Moreover, combinations of features and steps disclosed in the following detailed description may not be necessary to practice the present disclosure in the broadest sense, and are instead taught merely to particularly describe representative examples of the present disclosure. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In one or more embodiments, the reel attaching part may comprise a turntable rotatably supported by the support. The bobbin may be fixed to the turntable when the reel is attached to the reel attaching part.

According to the configuration above, since the turntable is supported by the support, there is no need to attach/detach the turntable to/from the support. Thus, displacement of a rotation axis of the turntable can be suppressed. Displacement of a rotation axis of the reel thus can be suppressed.

In one or more embodiments, the rebar tying tool may further comprise a movable member movably supported by the turntable. The detection target portion may comprise a projection. The movable member may be at an initial position when the reel is not attached to the reel attaching part. The projection may be configured to push the movable member toward an attaching position when the reel is attached to the reel attaching part. Each of the plurality of detectors may be configured to detect the detection target portion by detecting the movable member at the attaching position.

According to the configuration above, specific information of the reel can be detected with a simple configuration of detecting the position of the movable member, before the reel finishes rotating once.

In one or more embodiments, the rebar tying tool may further comprise a type-detecting magnet fixed to the movable member. Each of the plurality of detectors may comprise a type-detecting magnetic sensor configured to detect whether the movable member is at the attaching position by detecting the type-detecting magnet.

In case of using an optical sensor, for example, a photointerrupter, the detection sensitivity of the photointerrupter may be decreased if the photointerrupter is contaminated by a foreign matter, etc. or if the photointerrupter is exposed to scattering light. According to the configuration above, the type-detecting magnetic sensor detects whether the movable member is at the attaching position or not, for example, by detecting magnetic variations caused by the type-detecting magnet. Whether the movable member is at the attaching position or not can be detected without the influence of contamination by foreign matters and scattering light, as compared to using a photointerrupter.

In one or more embodiments, the rebar tying tool may further comprise a biasing member configured to bias the movable member toward the initial position when the reel is detached from the reel attaching part.

According to the configuration above, the movable member can be returned to the initial position when the reel is detached from the reel attaching part.

In one or more embodiments, the bobbin may comprise: a trunk around which the wire is wound; and a flange disposed at one end of the trunk. The projection may project outward beyond an outer surface of the flange along a rotation axis of the reel. The turntable may comprise a receiver configured to receive and engage with the projection.

According to the configuration above, the reel can be fixed to the turntable with a simple configuration.

In one or more embodiments, each of the plurality of detectors may comprise a rotation detector configured to detect a rotation angle of the reel.

According to the configuration above, the detectors can be used to detect not only the type of the reel but also the rotation of the reel.

In one or more embodiments, the rebar tying tool may further comprise a rotation-detecting magnet configured to integrally rotate with the reel. Each rotation detector may comprise a rotation-detecting magnetic sensor configured to detect the rotation angle of the reel by detecting the rotation-detecting magnet.

In case of using an optical sensor, for example, a photointerrupter, the detection sensitivity may be decreased if the photointerrupter is contaminated by a foreign matter, etc. or if the photointerrupter is exposed to scattering light. According to the configuration above, the rotation-detecting magnetic sensors detect the rotation angle of the reel, for example, by detecting magnetic variations caused by the rotation-detecting magnet. The rotation angle of the reel can be detected without the influence of contamination by foreign matters and scattering light, as compared to using a photointerrupter.

In one or more embodiments, the plurality of detectors may be fixed to the support.

According to the configuration above, the position of the plurality of detectors does not change even when the reel rotates. Thus, the detection target portion can be detected accurately by the plurality of detectors.

In one or more embodiments, the plurality of detectors may comprise N detectors, wherein the N is an integer greater than or equal to 2. The detectors adjacent to each other may be disposed along the rotation direction at intervals corresponding to an angle of 360/N degrees.

According to the configuration above, specific information of the reel can be detected by the reel rotating by the angle of 360/N degrees.

In one or more embodiments, the plurality of detectors may comprise N detectors, wherein the N is an integer greater than or equal to 2. A maximum interval between the detectors adjacent to each other may be an interval corresponding to a specific angle that is greater than an angle of 360/N degrees along the rotation direction.

According to the configuration above, specific information of the reel can be detected by the reel rotating by the specific angle that is smaller than an angle of 360 degrees.

First Embodiment

As shown in FIG. 1, a rebar tying tool 2 is configured to tie a plurality of rebars R with a wire W. For example, the rebar tying tool 2 ties, with the wire W, rebars R having a small diameter of 16 mm or less or rebars R having a large diameter of greater than 16 mm (e.g., 25 mm or 32 mm). The diameter of the wire W is, for example, within a range from 0.5 mm to 2.0 mm.

As shown in FIG. 1, the rebar tying tool 2 comprises a main body 4, a grip 6, a battery attaching part 8, a battery pack B, and a reel holder 10. The grip 6 is configured to be gripped by an operator. The grip 6 is disposed at a lower rear portion of the main body 4. The grip 6 is integral with the main body 4. A trigger 12 is disposed at an upper front portion of the grip 6. A trigger switch 14 (see FIG. 3) configured to detect whether the trigger 12 is pressed or not is disposed within the grip 6. The battery attaching part 8 is disposed at a lower portion of the grip 6. The battery attaching part 8 is integral with the grip 6. The battery pack B can be attached to and detached from the battery attaching part 8 by being slid with respect to the battery attaching part 8. The battery pack B comprises, for example, secondary batteries such as lithium-ion batteries. The reel holder 10 is disposed at a lower front portion of the main body 4. The reel holder 10 is disposed forward of the grip 6. In the present embodiment, a longitudinal direction of a twisting unit 46 (which will be described later) is termed a front-rear direction, a direction perpendicular to the front-rear direction is termed an up-down direction, and a direction perpendicular to the front-rear direction and the up-down direction is termed a right-left direction.

Figure 2:
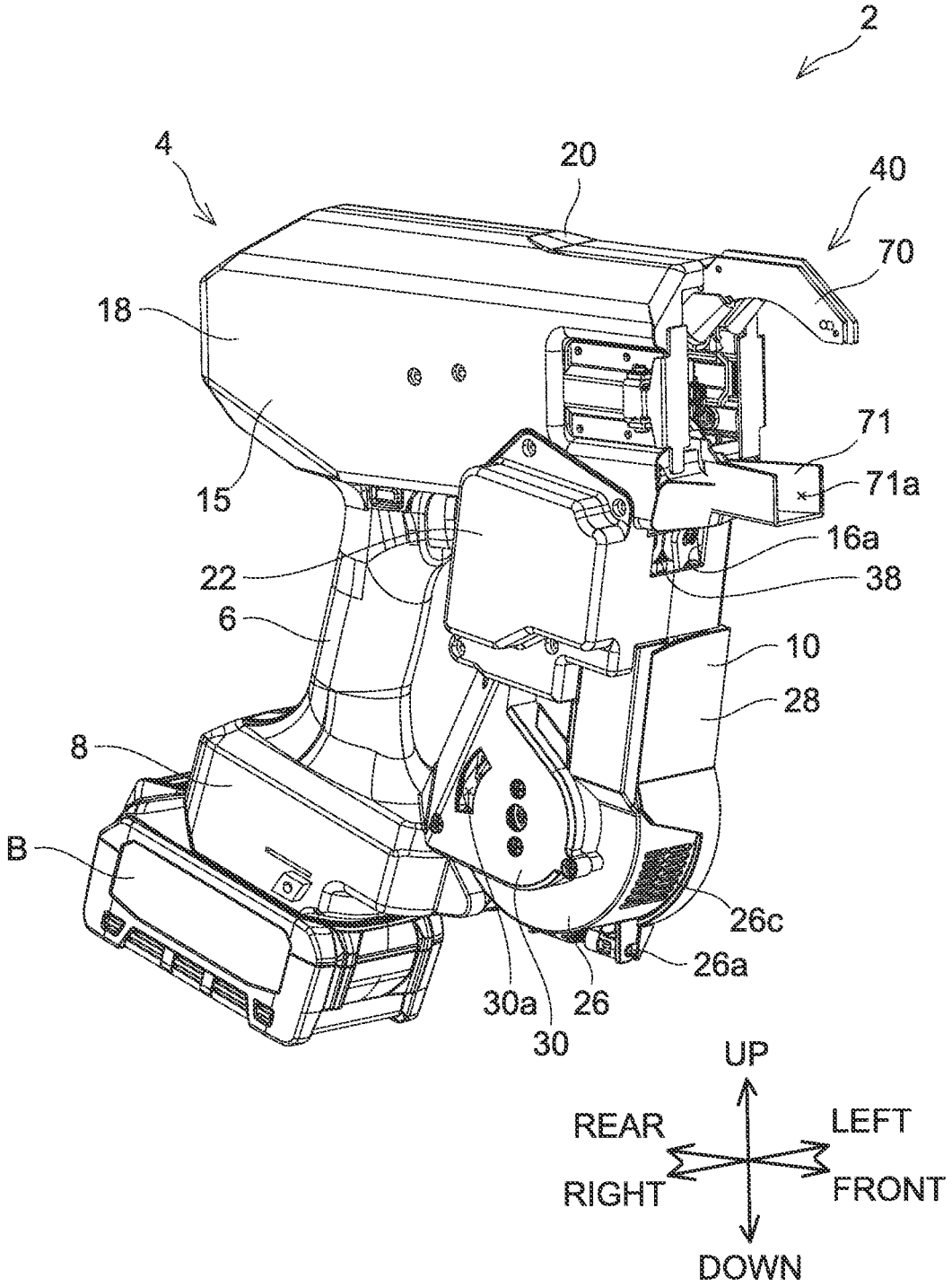
FIG. 2 is a perspective view of the rebar tying tool 2 according to the first embodiment, as viewed from the upper right front side.

The rebar tying tool 2 comprises a housing 16. The housing 16 constitutes a part of a support 15. As shown in FIG. 2, the housing 16 comprises a right housing 18, a left housing 20, and a motor cover 22. The right housing 18 defines shapes of right halves of the main body 4, the grip 6, and the battery attaching part 8. The left housing 20 defines shapes of left halves of the main body 4, the grip 6, and the battery attaching part 8. The motor cover 22 is attached to an outer side of the right housing 18. As shown in FIG. 1, an operation display 24 is disposed at an upper rear portion of the left housing 20. The operation display 24 comprises a main power switch 24*a* and a main power LED 24*b*. The main power switch 24*a* is configured to receive an operation to turn on/turn off the rebar tying tool 2 from the user. The main power LED 24*b* is configured to display whether the rebar tying tool 2 is on or off.

As shown in FIG. 2, the reel holder 10 comprises a holder housing 26, a main cover 28, and an auxiliary cover 30. The holder housing 26 and the auxiliary cover 30 constitute a part of the support 15. The holder housing 26 is fixed to the lower front portion of the main body 4 and a front portion of the battery attaching part 8. The holder housing 26 includes an opening at its left end. The main cover 28 is attached to the holder housing 26 such that the main cover 28 is pivotable about a pivot axis 26*a* at a lower portion of the holder housing 26. The main cover 28 is biased in its opening direction by a torsion spring 31 (see FIG. 3). A closed state detecting sensor (not shown) configured to detect that the main cover 28 is in a closed state is attached to the holder housing 26. The auxiliary cover 30 covers a right surface of the holder housing 26. The auxiliary cover 30 defines an auxiliary space 30*a* between the right surface of the holder housing 26 and the auxiliary cover 30.

As shown in FIG. 1, a lock lever 32 for keeping the main cover 28 closed is disposed at a lower front portion of the left housing 20. When the lock lever 32 is pivoted, the main cover 28 is opened with respect to the holder housing 26 by the biasing force of the torsion spring 31 (see FIG. 3). While the main cover 28 is in the closed state, a housing space 26*b* (see FIG. 3) is defined by the holder housing 26 and the main cover 28. A reel 33 (see FIG. 3) comprising the wire W is disposed in the housing space 26*b*. As shown in FIG. 2, a hole 26*c* is defined in a front surface of the holder housing 26. The user can check a remaining amount of the wire W on the reel 33 by seeing the reel 33 through the hole 26*c*.

Figure 3:
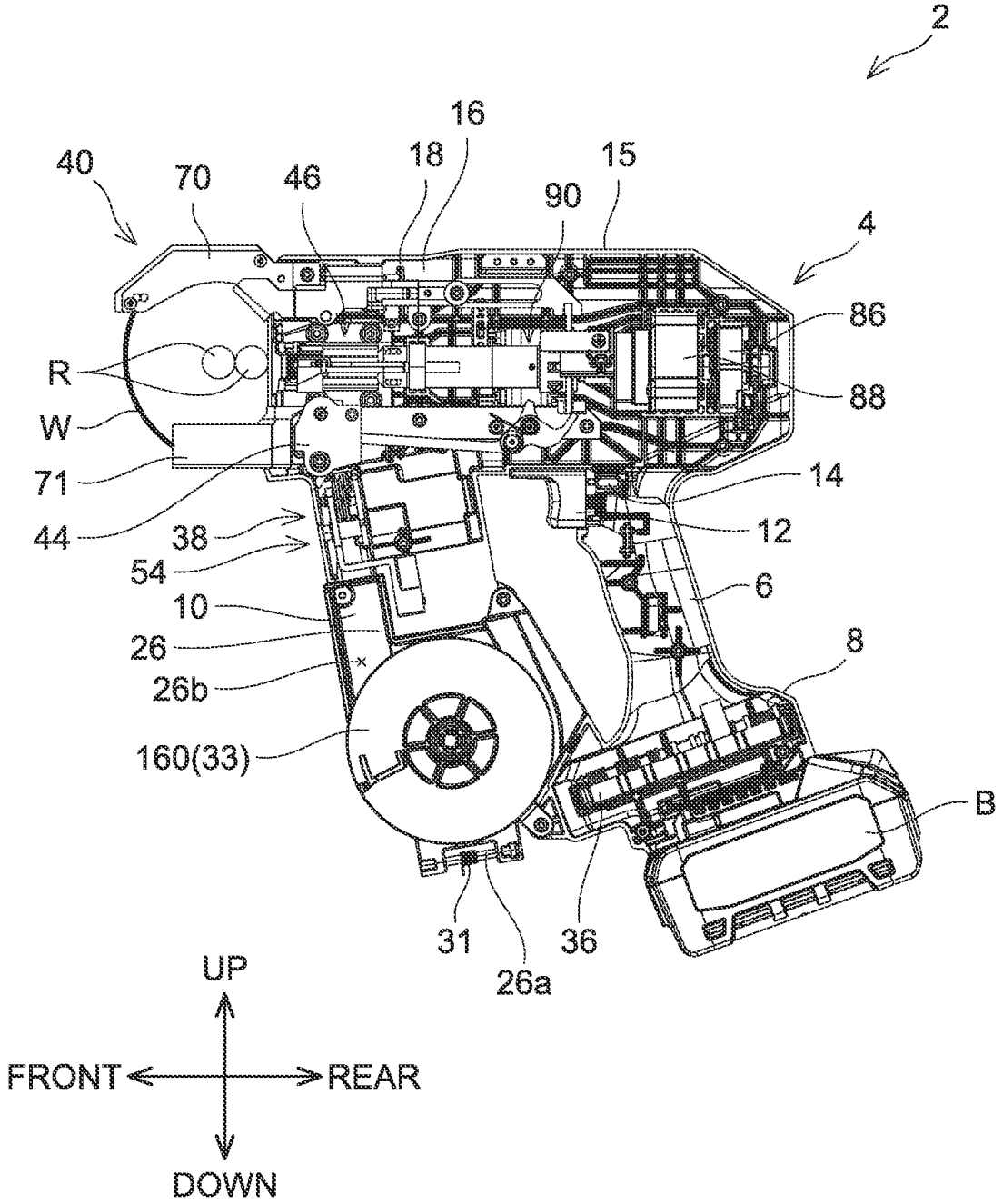
FIG. 3 is a side view of an internal configuration of the rebar tying tool 2 according to the first embodiment.

As shown in FIG. 3, the rebar tying tool 2 comprises a control circuit board 36. The control circuit board 36 is disposed within the battery attaching part 8. The control circuit board 36 is electrically connected to each of the battery pack B, the trigger switch 14, and the operation display 24 via wires which are not shown. Further, the control circuit board 36 is electrically connected to the closed state detecting sensor (not shown) attached to the holder housing 26 via a wire which is not shown.

The rebar tying tool 2 comprises a feeding unit 38, a guiding unit 40, a cutter unit 44, and a twisting unit 46. The feeding unit 38 is disposed within the front lower portion of the main body 4. The guiding unit 40 is disposed at a front portion of the main body 4. The cutter unit 44 is disposed within a lower portion of the main body 4. The twisting unit 46 is disposed within the body 4.

Figure 4:
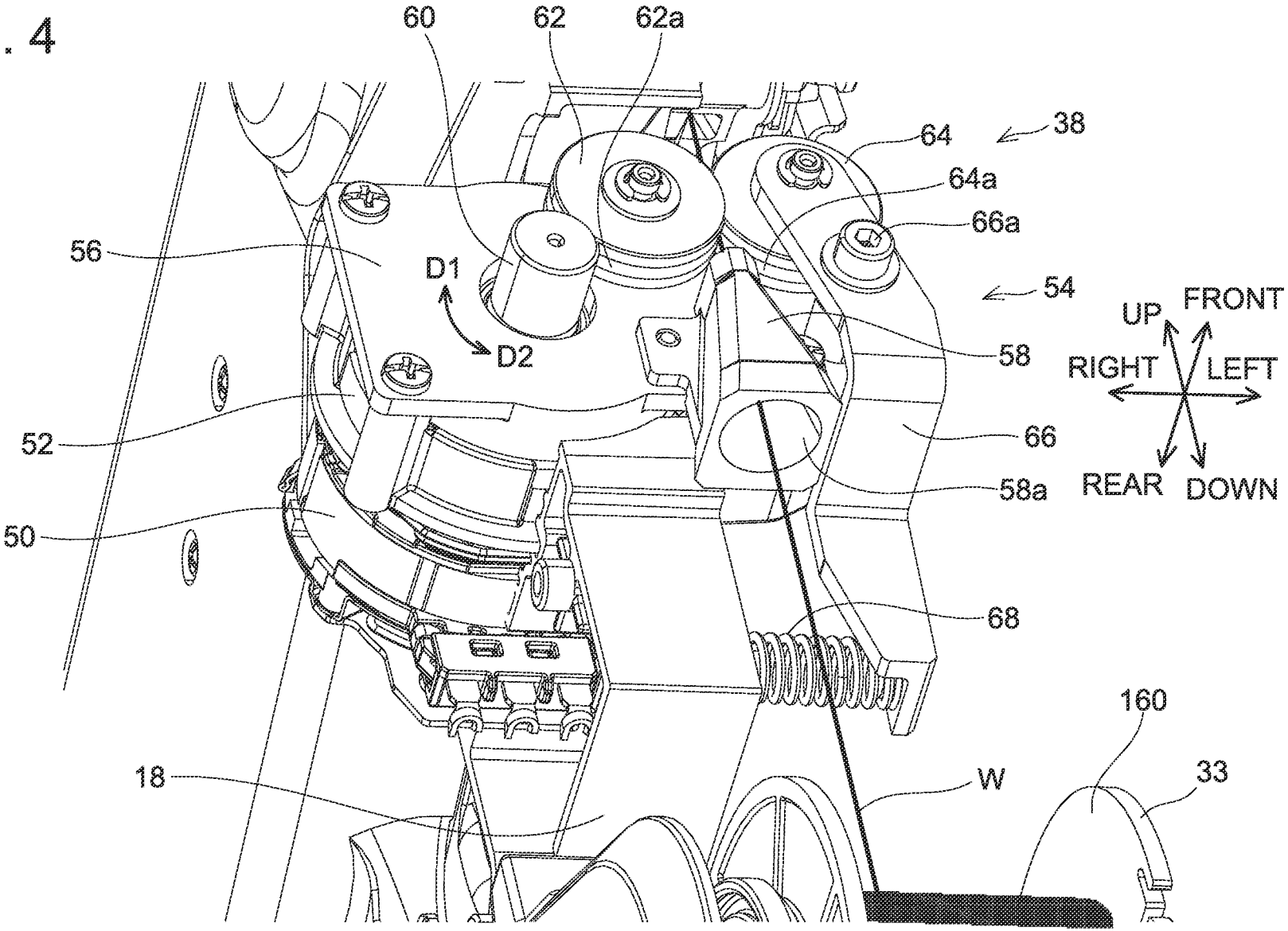
FIG. 4 is a perspective view of a feeding unit 38 according to the first embodiment.

As shown in FIG. 4, the feeding unit 38 comprises a feeding motor 50, a reducer 52, and a feeder 54. The feeding motor 50 is, for example, a brushless motor. The feeding motor 50 is disposed rightward of the right housing 18 (see FIG. 2) and is covered by the motor cover 22 (see FIG. 2). The feeding motor 50 is electrically connected to the control circuit board 36 via a wire which is not shown. The feeding motor 50 operates by electric power supplied from the battery pack B (see FIG. 2).

The reducer 52 comprises, for example, a planetary gear mechanism. The reducer 52 is configured to reduce the rotational speed of the feeding motor 50.

The feeder 54 comprises a base 56, a guide 58, a drive gear 60, a first feed gear 62, a second feed gear 64, a release lever 66, and a compression spring 68. The guide 58 is fixed to the base 56. The guide 58 has a guide hole 58*a*. The guide hole 58*a* has a tapered shape with a broad lower end and a narrower upper end. The wire W is inserted through the guide hole 58*a*.

Figure 5:
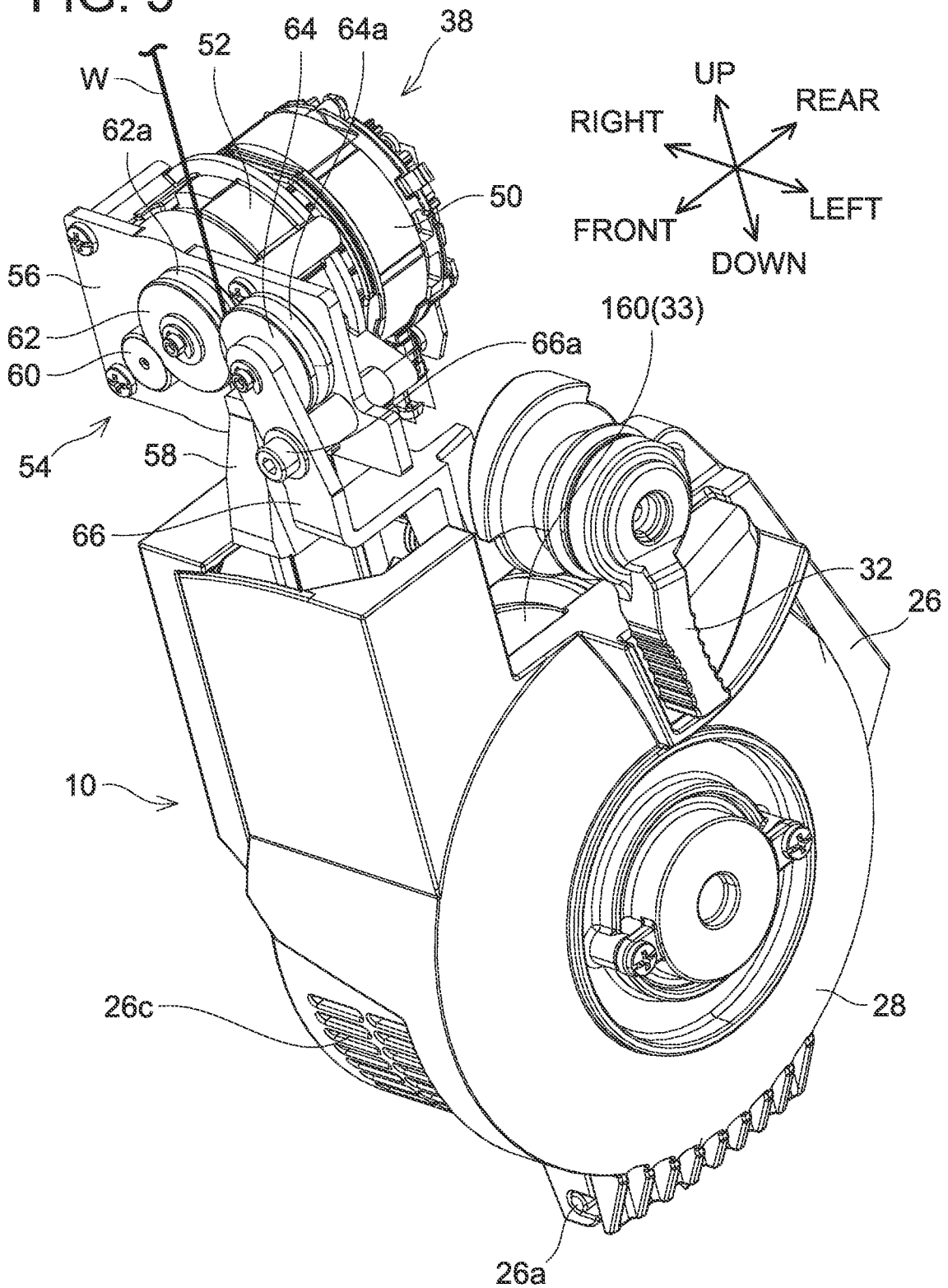
FIG. 5 is a perspective view of the feeding unit 38 and a reel holder 10 according to the first embodiment.

Rotation is transmitted to the drive gear 60 from the reducer 52. The first feed gear 62 is rotatably supported by the base 56. The first feed gear 62 is meshed with the drive gear 60. The first feed gear 62 is rotated by the rotation of the drive gear 60. The first feed gear 62 has a groove 62*a*. The groove 62*a* is defined in an outer circumferential surface of the first feed gear 62 and extends in a direction along a rotation direction of the first feed gear 62. The second feed gear 64 is configured to mesh with the first feed gear 62. The second feed gear 64 is rotatably supported by the release lever 66. The second feed gear 64 has a groove 64*a*. The groove 64*a* is defined in an outer circumferential surface of the second feed gear 64 and extends in a direction along a rotation direction of the second feed gear 64. The release lever 66 is swingably supported by the base 56 via a swing shall 66*a*. The compression spring 68 biases the release lever 66 with respect to the right housing 18 (see FIG. 2) in a direction that brings the second feed gear 64 closer to the first feed gear 62. Thus, the second feed gear 64 is pressed against the first feed gear 62. The wire W is thereby held between the groove 62*a* of the first feed gear 62 and the groove 64*a* of the second feed gear 64. As shown in FIG. 5, when the lock lever 32 is pivoted in a direction that releases the retention of the main cover 28, a lower end of the release lever 66 is pushed by the lock lever 32 to move toward the right housing 18. The second feed gear 64 is thereby separated away from the first feed gear 62. In this state, the user can place the wire W of the reel 33 (see FIG. 4) between the groove 62*a* of the first feed gear 62 and the groove 64*a* of the second feed gear 64. As shown in FIG. 2, a window 16*a* is defined in front surfaces of the left housing 20 and the motor cover 22, and the user can see a site where the first feed gear 62 meshes with the second feed gear 64 through the window 16*a*.

The wire W is moved when the feeding motor 50 rotates with the wire W held between the groove 62*a* of the first feed gear 62 and the groove 64*a* of the second feed gear 64, as shown in FIG. 4. In the present embodiment, when the feeding motor 50 rotates forward, the drive gear 60 is rotated in a direction D1 shown in FIG. 4 and the wire W is fed out from the reel 33 toward the guiding unit 40. When the feeding motor 50 rotates in reverse, the drive gear 60 is rotated in a direction D2 shown in FIG. 4 and the wire W is pulled back toward the reel 33 from the feeding unit 38.

Figure 6:
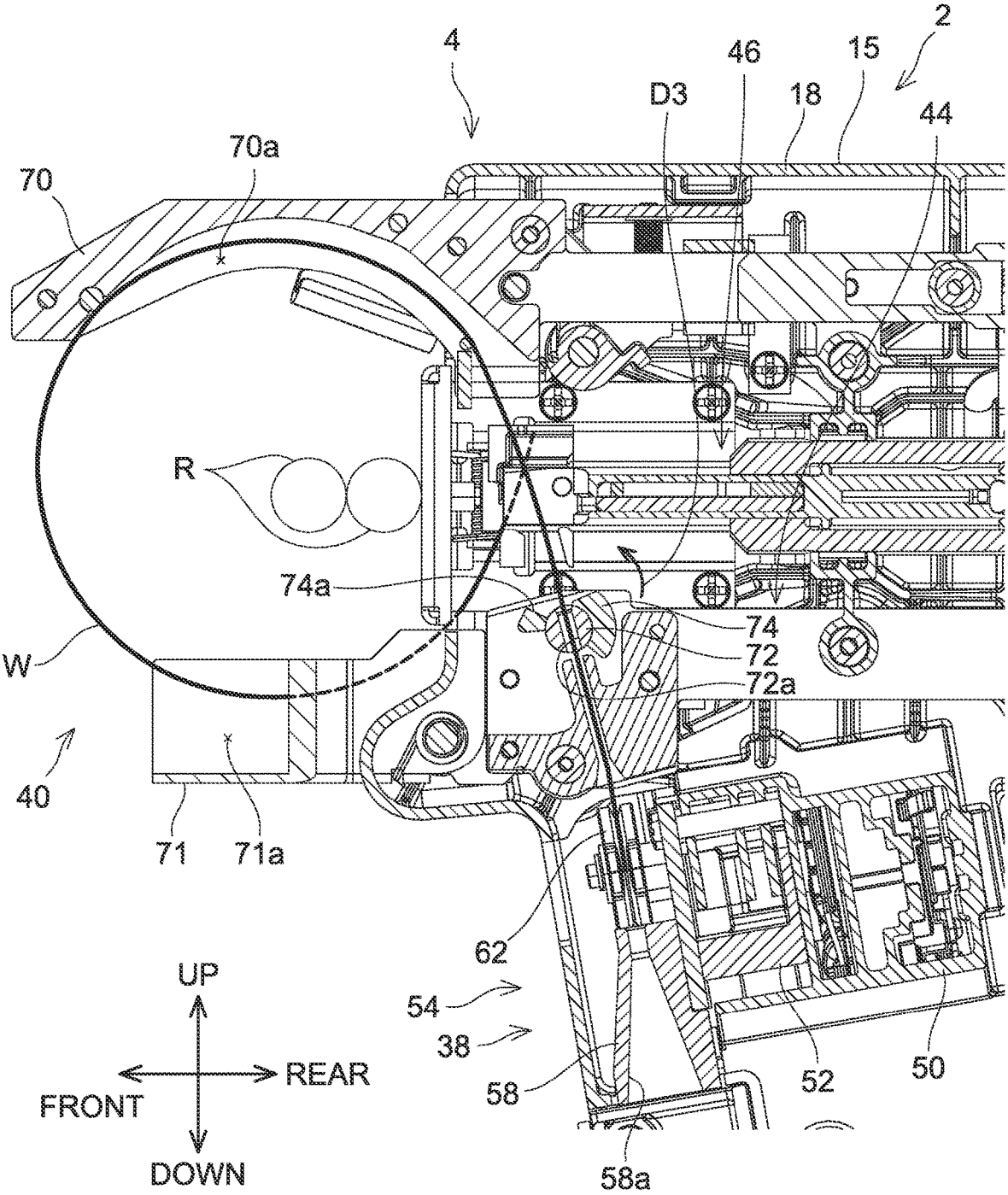
FIG. 6 is a cross-sectional view of the rebar tying tool 2 according to the first embodiment, in the vicinity of its upper front portion.

As shown in FIG. 6, the guiding unit 40 comprises an upper curl guide 70 and a lower curl guide 71. The upper curl guide 70 and the lower curl guide 71 are disposed at the front portion of the main body 4. A lower end of the upper curl guide 70 is open downward. Thereby, an upper wire passage 70*a* is defined in the upper curl guide 70. The lower curl guide 71 is disposed below the upper curl guide 70. An upper end of the upper curl guide 70 is open upward. Thereby, a lower wire passage 71*a* is defined in the lower curl guide 71.

The wire W fed out from the feeding unit 38 (see FIG. 4) is directed into the upper wire passage 70*a*. The wire W passes through the upper wire passage 70*a* from the rear toward the front. During this passing, a downward curl is given to the wire W. After passing through the upper wire passage 70*a*, the wire W is directed into the lower wire passage 71*a*. The wire W passes through the lower wire passage 71*a* from the front toward the rear. Thus, the wire W is wound around the rebars R.

Figure 7:
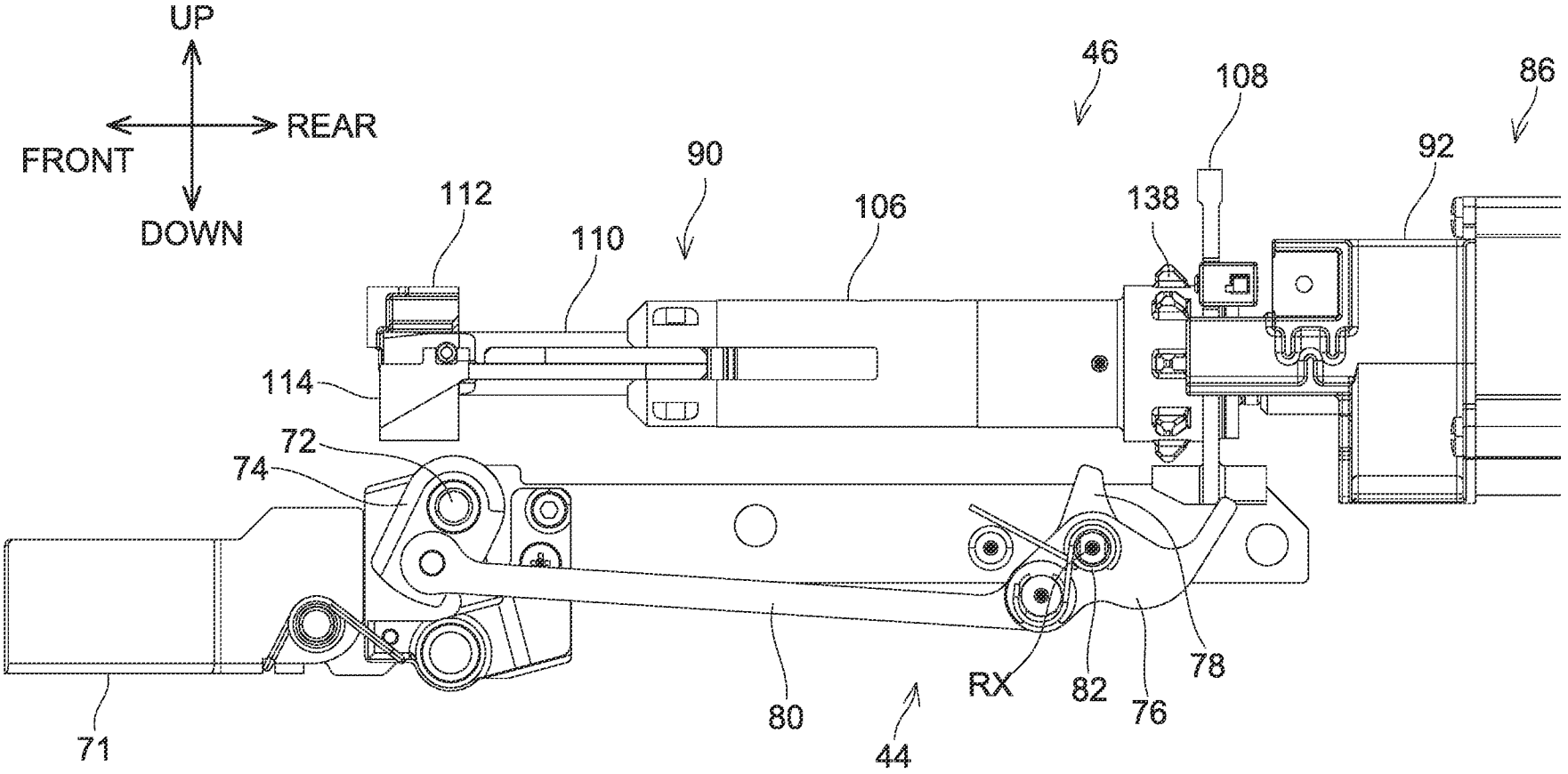
FIG. 7 is a side view of a cutter unit 44 according to the first embodiment, illustrating a state before a first lever 76 and a second lever 78 pivot.

As shown in FIG. 7, the cutter unit 44 comprises a fixed cutter 72, a movable cutter 74, a first lever 76, a second lever 78, a link 80, and a torsion spring 82. As shown in FIG. 6, the fixed cutter 72 and the movable cutter 74 are disposed on the path along which the wire W is directed to the guiding unit 40 from the feeding unit 38. The fixed cutter 72 has a hole 72*a* through which the wire W passes. The movable cutter 74 is supported by the fixed cutter 72 such that the movable cutter 74 can slide along and rotate about the fixed cutter 72. The movable cutter 74 has a hole 74*a* through which the wire W can pass. When the hole 74*a* of the movable cutter 74 is in communication with the hole 72*a* of the fixed cutter 72 (this state may be termed "communicated state" hereinbelow) as shown in FIG. 7, the wire W can pass through the hole 72*a* of the fixed cutter 72 and the hole 74*a* of the movable cutter 74. Then, when the movable cutter 74 is rotated with respect to the fixed cutter 72 in a direction D3 shown in FIG. 6 (this state may be termed "cutting state" hereinbelow), the wire W is cut by the fixed cutter 72 and the movable cutter 74.

As shown in FIG. 7, the first lever 76 and the second lever 78 are fixed to each other. The first lever 76 and the second lever 78 are swingable about an axis RX. Lower ends of the first lever 76 and the second lever 78 are rotatably coupled to a rear end of the link 80. A front end of the link 80 is rotatably coupled to a lower end of the movable cutter 74. The rear end of the link 80 is biased forward by the torsion spring 82. When the lower ends of the first lever 76 and the second lever 78 are swung forward, the link 80 is moved forward and the fixed cutter 72 and the movable cutter 74 are thereby brought into the communicated state. When the lower ends of the first lever 76 and the second lever 78 are swung rearward, the link 80 is moved rearward and the fixed cutter 72 and the movable cutter 74 are thereby brought into the cutting state.

Figure 9:
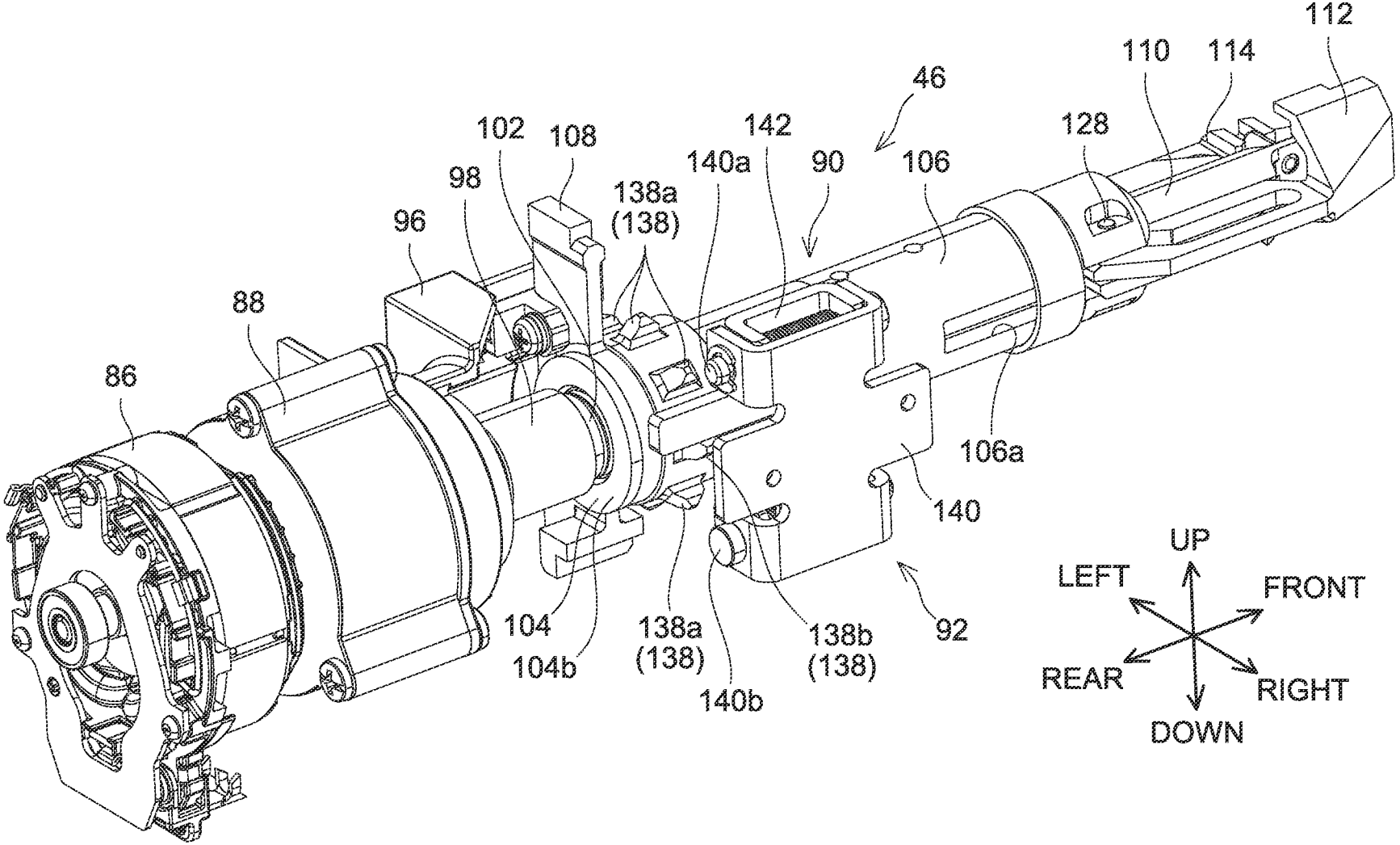
FIG. 9 is a perspective view of a twisting unit 46 according to the first embodiment.

As shown in FIG. 9, the twisting unit 46 comprises a twisting motor 86, a reducer 88, a retainer 90, and a rotation restrictor 92. The twisting motor 86 is, for example, a brushless motor. The twisting motor 86 is fixed to the right housing 18 (see FIG. 1) and the left housing 20 (see FIG. 1). The twisting motor 86 is electrically connected to the control circuit board 36 (see FIG. 3) via a wire which is not shown. The twisting motor 86 operates by electric power supplied from the battery pack B (see FIG. 1).

The reducer 88 is fixed to the right housing 18 and the left housing 20. The reducer 88 comprises, for example, a planetary gear mechanism. The reducer 88 is configured to reduce the rotational speed of the twisting motor 86.

Figure 10:
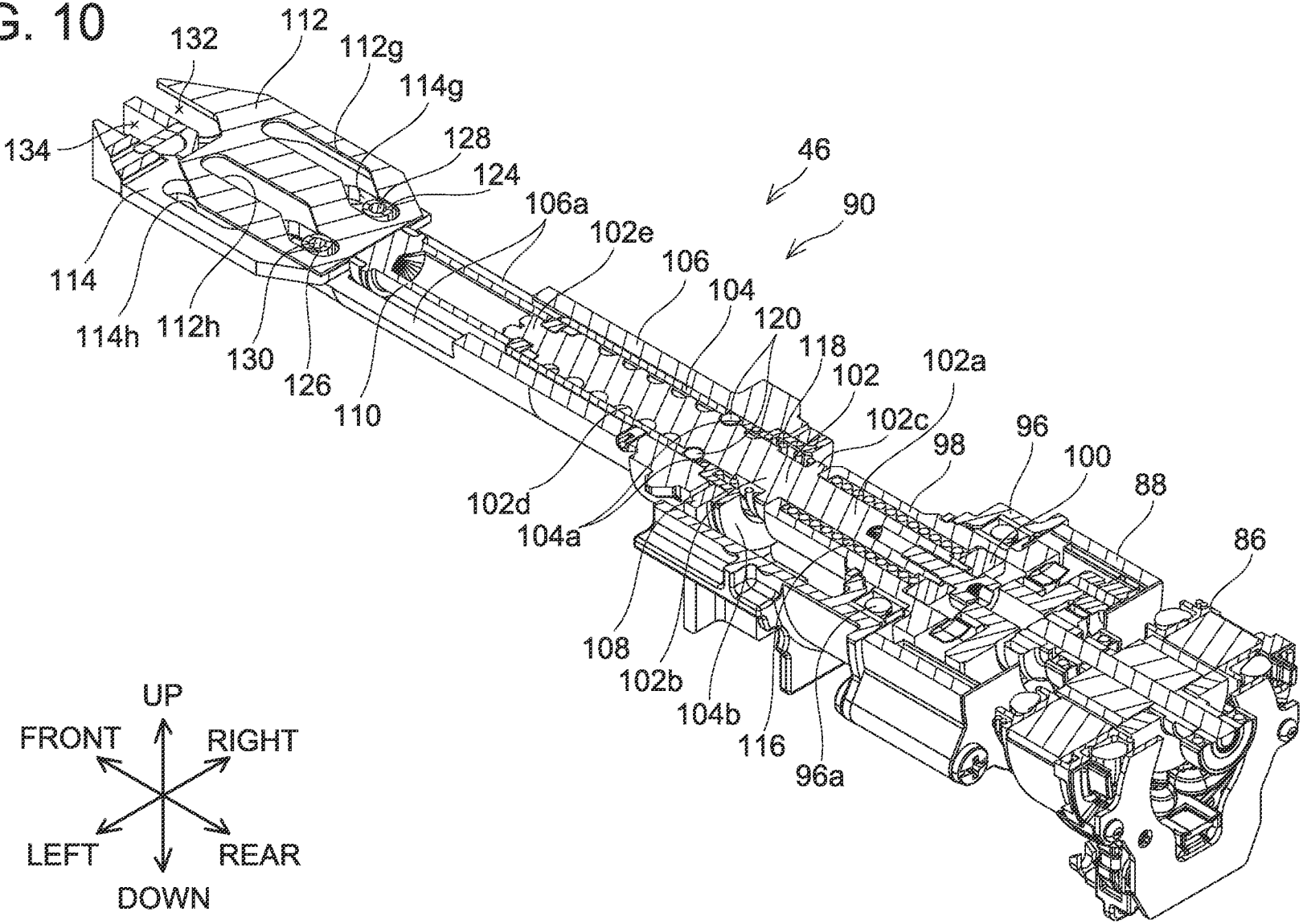
FIG. 10 is a cross-sectional view of a twisting motor 86, a reducer 88, and a retainer 90 according to the first embodiment.

As shown in FIG. 10, the retainer 90 comprises a bearing box 96, a carrier sleeve 98, a clutch plate 100, a screw shaft 102, an inner sleeve 104, an outer sleeve 106, a push plate 108, a clamp shaft 110, a right clamp 112, and a left clamp 114.

The bearing box 96 is fixed to the reducer 88. The bearing box 96 supports the carrier sleeve 98 via a bearing 96*a* such that the carrier sleeve 98 is rotatable. Rotation is transmitted to the carrier sleeve 98 from the reducer 88. When the twisting motor 86 rotates forward, the carrier sleeve 98 is rotated counterclockwise as viewed from the rear. When the twisting motor 86 rotates in reverse, the carrier sleeve 98 is rotated clockwise as viewed from the rear.

Figure 11:
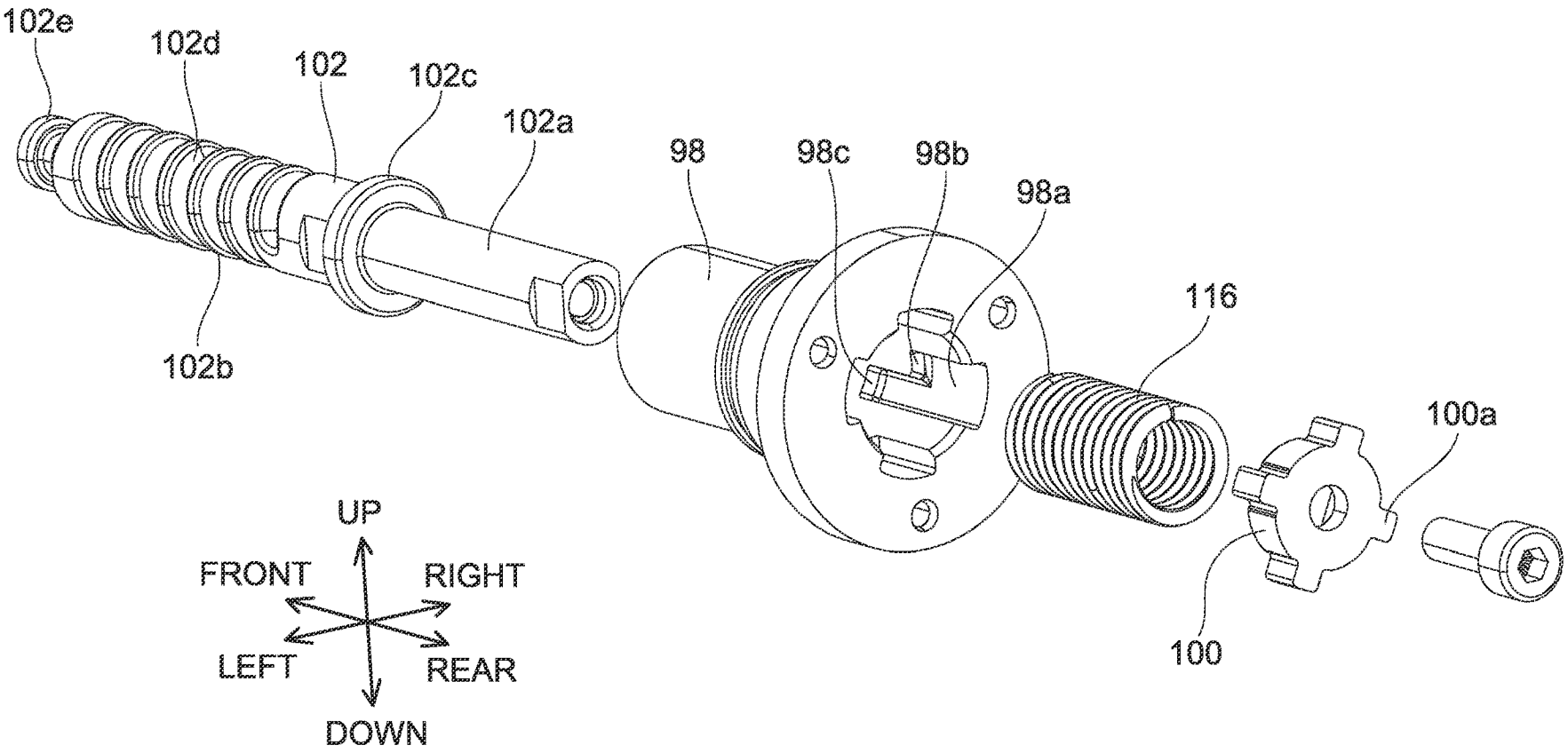
FIG. 11 is an exploded perspective view of a carrier sleeve 98, a clutch plate 100, and a screw shaft 102 according to the first embodiment.

As shown in FIG. 11, a clutch groove 98*a* extending in the front-rear direction is defined in an inner surface of a rear portion of the carrier sleeve 98. The clutch groove 98*a* includes a first wall 98*b* and a second wall 98*c* at its front ends. A distance from a rear end of the carrier sleeve 98 to the first wall 98*b* in the front-rear direction is shorter than a distance from the rear end of the carrier sleeve 98 to the second wall 98*c* in the front-rear direction. The clutch plate 100 is disposed inside the carrier sleeve 98. The clutch plate 100 includes a clutch piece 100*a* corresponding to the clutch groove 98*a*. The clutch plate 100 is biased rearward with respect to the carrier sleeve 98 by a compression spring 116 disposed inside the carrier sleeve 98. The clutch plate 100 is movable forward with respect to the carrier sleeve 98 until the clutch piece 100*a* contacts the first wall 98*b* of the clutch groove 98*a*. When the wire W is twisted, the carrier sleeve 98 is rotated counterclockwise with respect to the clutch plate 100 as viewed from the rear, and thus the clutch plate 100 can move forward with respect to the carrier sleeve 98 until the clutch piece 100*a* contacts the second wall 98*c* of the clutch groove 98*a*.

A rear portion 102*a* of the screw shaft 102 is inserted into the carrier sleeve 98 from the front and is fixed to the clutch plate 100. The screw shaft 102 includes a radially protruding flange 102*c* between the rear portion 102*a* and a front portion 102*b* of the screw shaft 102. A spiral ball groove 102*d* is defined in an outer surface of the front portion 102*b* of the screw shaft 102. The screw shaft 102 includes an engagement portion 102*e* at its front end, and a diameter of the engagement portion 102*e* is smaller than that of the front portion 102*b*.

As shown in FIG. 10, a compression spring 118 is attached to the front portion 102*b* of the screw shall 102. The front portion 102*b* of the screw shaft 102 is inserted into the inner sleeve 104 from the rear. A ball hole 104*a* configured to hold balls 120 is defined in the inner sleeve 104. The balls 120 fit in a ball groove 102*d* of the screw shaft 102. The inner sleeve 104 includes a radially protruding flange 104*b* at its rear end. The inner sleeve 104 is inserted into the outer sleeve 106 from the rear. The outer sleeve 106 is fixed to the inner sleeve 104. In the case where the rotation restrictor 92 (see FIG. 17) permits the outer sleeve 106 to rotate, the inner sleeve 104 and the outer sleeve 106 are integrally rotated when the screw shaft 102 rotates. In the case where the rotation restrictor 92 prohibits the outer sleeve 106 from rotating, the inner sleeve 104 and the outer sleeve 106 are moved in the front-rear direction with respect to the screw shaft 102 when the screw shaft 102 rotates. Specifically, when the screw shaft 102 rotates counterclockwise as viewed from the rear by the twisting motor 86 rotating forward, the inner sleeve 104 and the outer sleeve 106 are moved forward with respect to the screw shaft 102. When the screw shaft 102 rotates clockwise as viewed from the rear by the twisting motor 86 rotating in reverse, the inner sleeve 104 and the outer sleeve 106 are moved rearward with respect to the screw shaft 102. The push plate 108 is disposed between the rear end of the outer sleeve 106 and the flange 104*b* of the inner sleeve 104. Thus, the push plate 108 is also moved in the front-rear direction when the inner sleeve 104 and the outer sleeve 106 are moved in the front-rear direction. Slits 106*a* extending rearward from a front end of the outer sleeve 106 are defined in the front portion of the outer sleeve 106.

Figure 12:
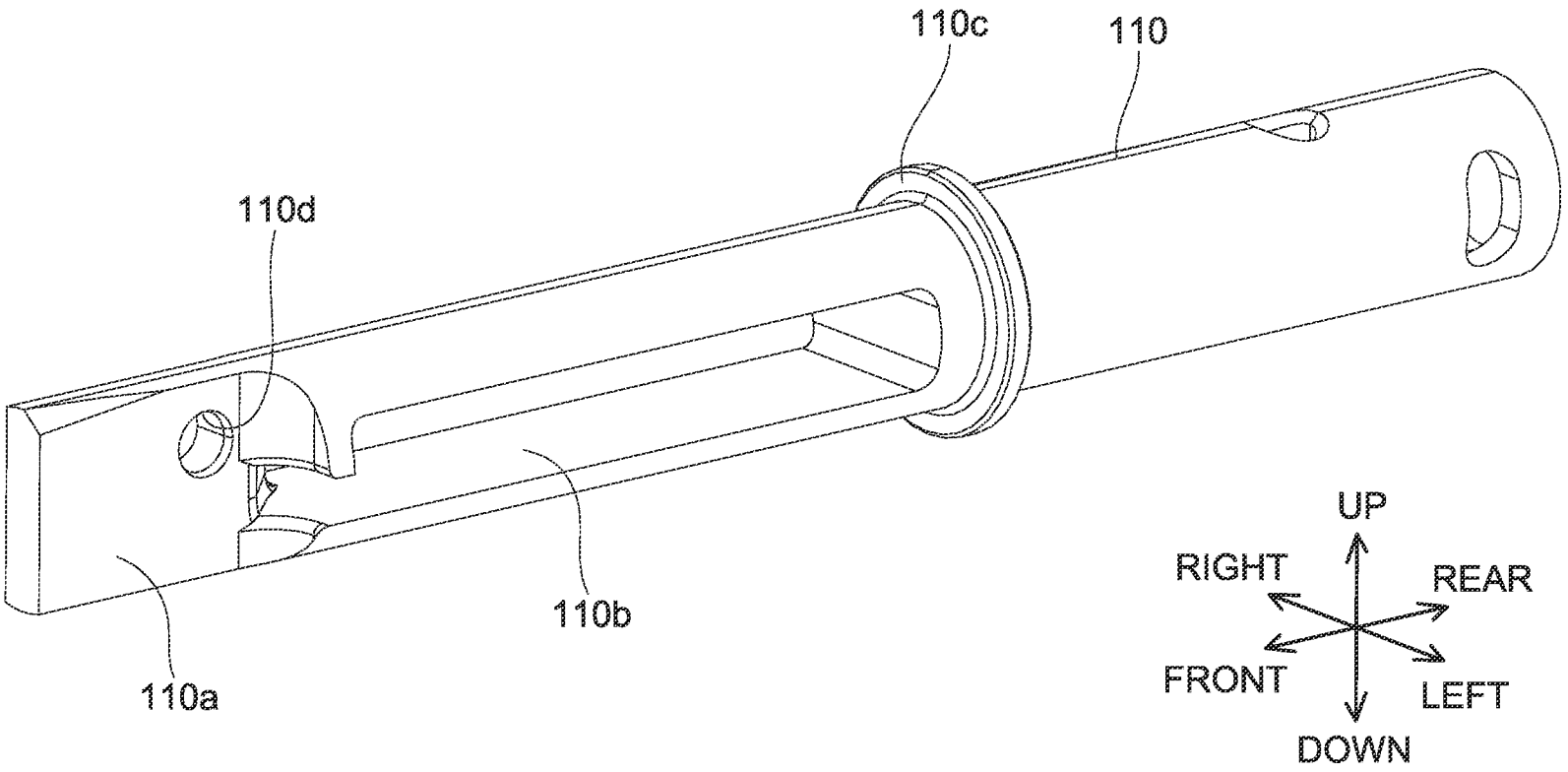
FIG. 12 is a perspective view of a clamp shaft 110 according to the first embodiment.

The clamp shaft 110 is inserted into the inner sleeve 104 from the front. The engagement portion 102*e* of the screw shaft 102 is inserted in a rear end of the clamp shaft 110. The clamp shaft 110 is fixed to the screw shaft 102. As shown in FIG. 12, the clamp shaft 110 includes a flat-plate portion 110*a*, an opening 110*b*, and a flange 110*c*. The flat-plate portion 110*a* is disposed at a front end of the clamp shaft 110 and has a flat-plate shape along the front-rear direction and the up-down direction. A hole 110*d* in which a pin 122 (see FIG. 13) fits is defined in the flat-plate portion 110*a*. The opening 110*b* is disposed rearward of the flat-plate portion 110*a*. The opening 110*b* penetrates the clamp shaft 110 in the right-left direction and extends in the front-rear direction. The flange 110*c* is disposed rearward of the opening 110*b* and protrudes radially.

Figure 13:
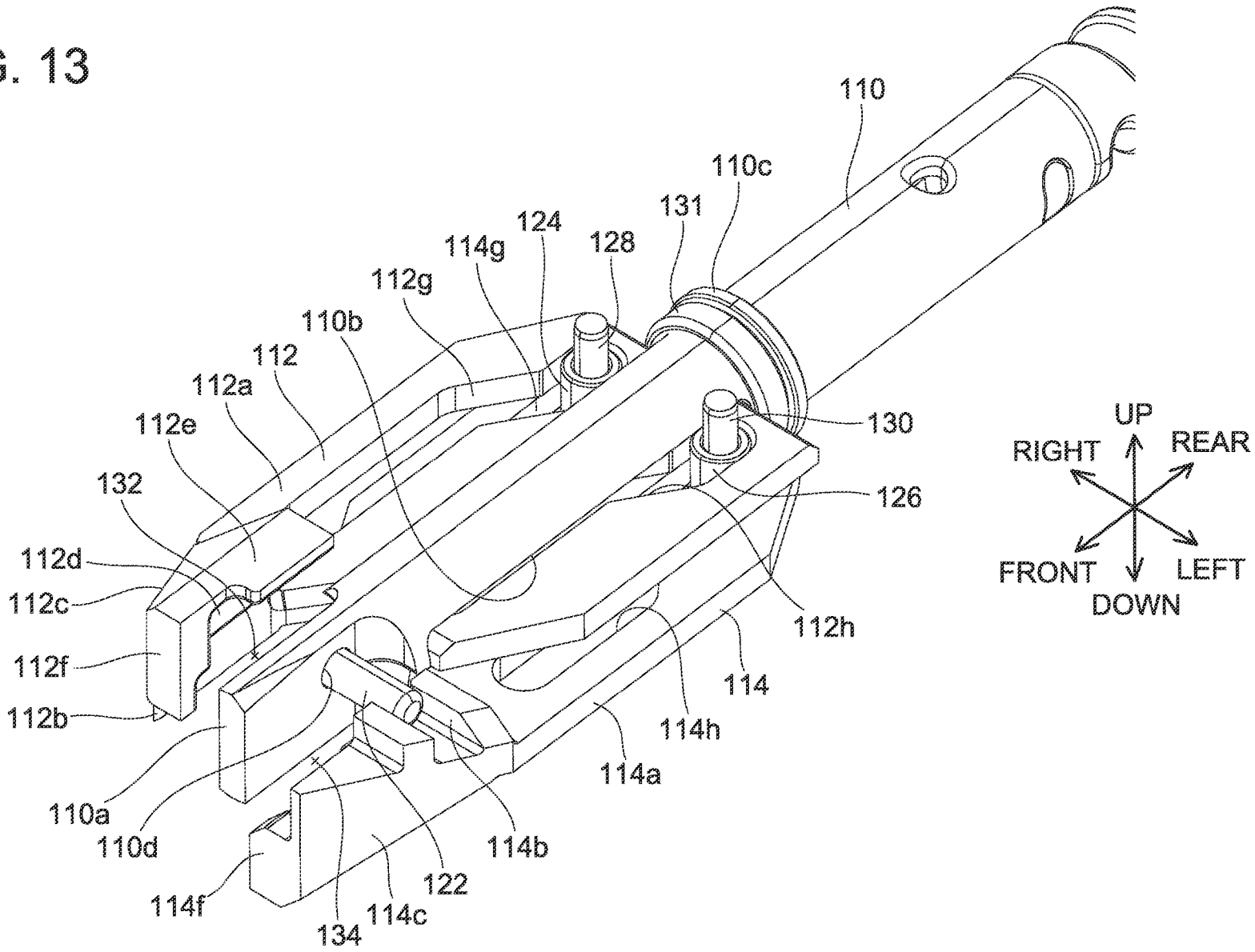
FIG. 13 is a perspective view of the twisting unit 46 according to the first embodiment, illustrating a state where a right clamp 112 and a left clamp 114 are attached to the clamp shaft 110.

As shown in FIG. 13, the right clamp 112 is attached to the clamp shaft 110 such that the right clamp 112 passes through the opening 110*b* of the clamp shaft 110 from the right to the left. Below the right clamp 112, the left clamp 114 is attached to the clamp shaft 110 such that the left clamp 114 passes through the opening 110*b* of the clamp shaft 110 from the left to the right.

Figure 14:
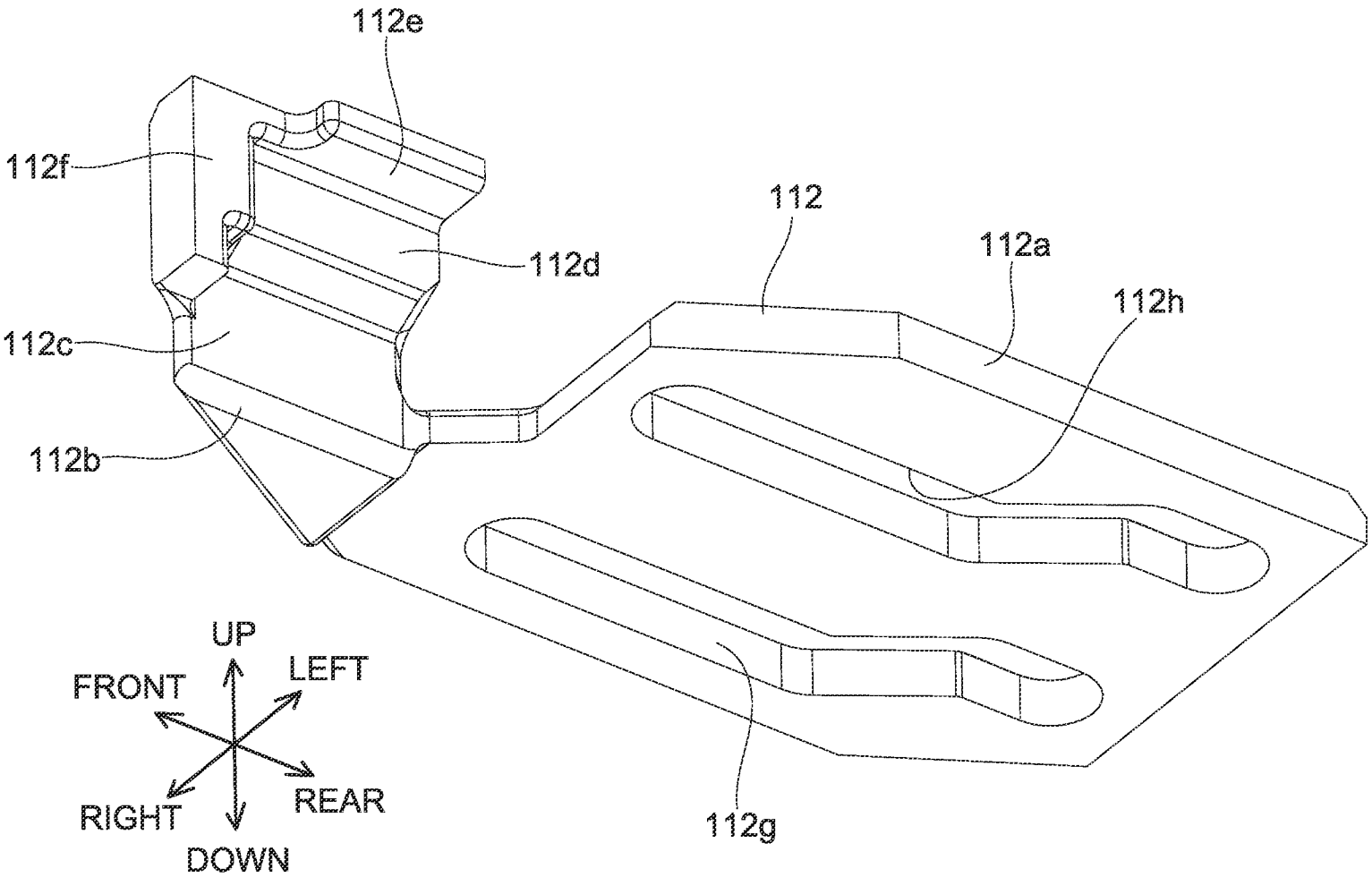
FIG. 14 is a perspective view of the right clamp 112 according to the first embodiment.

As shown in FIG. 14, the right clamp 112 comprises a base 112*a*, a downward protrusion 112*b*, an upward protrusion 112*c*, a contact portion 112*d*, an upper guard 112*e*, and a front guard 112*f* The base 112*a* has a flat-plate shape along the front-rear direction and the right-left direction. The downward protrusion 112*b* is disposed at a right front end of the base 112*a* and protrudes downward from the base 112*a*. The upward protrusion 112*c* is disposed at the right front end of the base 112*a* and protrudes upward from the base 112*a*. The contact portion 112*d* protrudes leftward from an upper end of the upward protrusion 112*c*. The upper guard 112*e* protrudes leftward from an upper end of the contact portion 112*d*. The front guard 112*f* protrudes leftward from front ends of the upward protrusion 112*c* and the contact portion 112*d*. Cam holes 112*g*, 112*h* are defined in the base 112*a*. From their rear ends toward front ends, the cam holes 112*g*, 112*h* extend forward from their rear ends, bend to extend diagonally forward right, and then bend again to extend forward.

Figure 15:
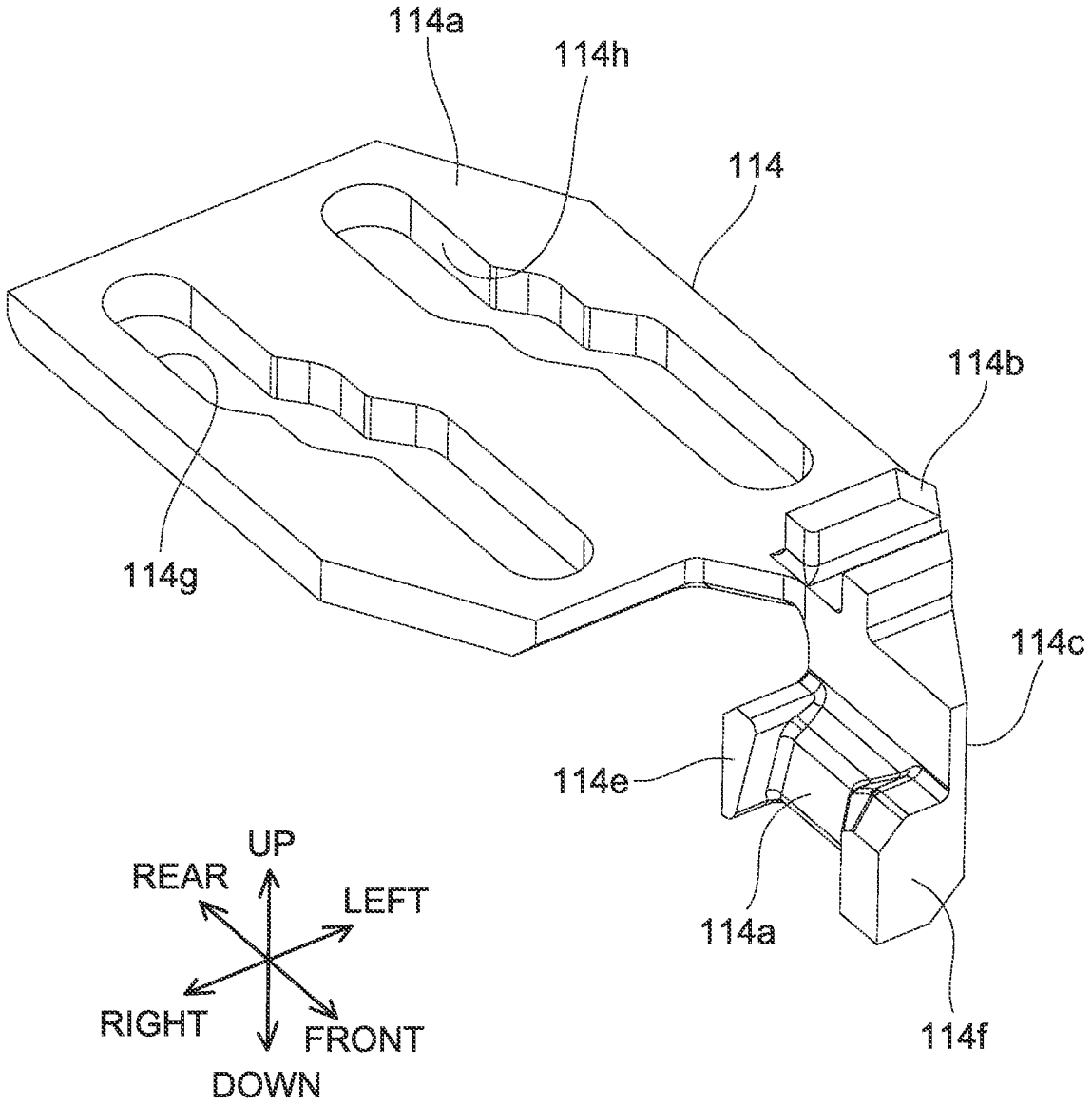
FIG. 15 is a perspective view of the left clamp 114 according to the first embodiment.

As shown in FIG. 15, the left clamp 114 comprises a base 114*a*, a pin retainer 114*b*, a downward protrusion 114*c*, a contact portion 114*d*, a rear guard 114*e*, and a front guard 114*f*. The base 114*a* has a flat-plate shape along the front-rear direction and the right-left direction. The pin retainer 114*b* is disposed at a left front end of the base 114*a* and retains the pin 122 (see FIG. 13) above the base 114*a* such that the pin 122 is slidable. The downward protrusion 114*c* is disposed at the left front end of the base 114*a* and protrudes downward from the base 114*a*. The contact portion 114*d* protrudes rightward from a lower end of the downward protrusion 114*c*. The rear guard 114*e* protrudes rightward from a rear end of the contact portion 114*d*. The front guard 114*f* protrudes rightward from a front end of the contact portion 114*d*. Cam holes 114*g*, 114*h* are defined in the base 114*a*. From their rear ends toward front ends, the cam holes 114*g*, 114*h* extend forward from their rear ends, bend to extend diagonally forward left, bend again to extend forward, bend to extend diagonally forward left again, and then bend to extend forward.

As shown in FIG. 13, in the state where the right clamp 112 and the left clamp 114 are attached to the clamp shall 110, a cam sleeve 124 extend through the cam holes 112*g* and 114*g* and a cam sleeve 126 extends through the cam holes 112*h* and 114*h*. Further, a support pin 128 extends through the cam sleeve 124 and a support pin 130 extend through the cam sleeve 126. An annular cushion 131 is attached between the right clamp 112 and the left clamp 114 and the flange 110*c* of the clamp shaft 110.

As shown in FIG. 9, in the state where the clamp shaft 110 is attached to the inner sleeve 104, the right clamp 112 and the left clamp 114 are in the slits 106*a* of the outer sleeve 106 and the support pins 128, 130 are coupled with the outer sleeve 106. When the clamp shaft 110 is moved in the front-rear direction with respect to the outer sleeve 106, the cam sleeve 124 attached to the support pin 128 is moved within the cam holes 112*g*, 114*g* in the front-rear direction and the cam sleeve 126 attached to the support pin 130 is moved within the cam holes 112*h*, 114*h* in the front-rear direction, and thereby the right clamp 112 and the left clamp 114 are moved in the right-left direction.

As shown in FIG. 13, in an initial state where the clamp shaft 110 protrudes forward from the outer sleeve 106, the right clamp 112 is positioned furthest to the right from the left clamp 114. In this state, a right wire passage 132 through which the wire W can pass is defined between the upward protrusion 112*c* of the right clamp 112 and the flat-plate portion 110*a* of the clamp shaft 110, and the upper guard 112*e* covers the right wire passage 132 from above. This state of the right clamp 112 is termed a fully-open state. When the outer sleeve 106 is moved forward with respect to the clamp shaft 110 in that state, the right clamp 112 is moved leftward toward the clamp shaft 110. In this state, the wire W is held between a lower end of the contact portion 112*d* of the right clamp 112 and an upper end of the flat-plate portion 110*a* of the clamp shaft 110 and a front end of the right wire passage 132 is covered by the front guard 112*f*. This state of the right clamp 112 is termed a fully-closed state.

In the initial state where the clamp shaft 110 protrudes forward from the outer sleeve 106, the left clamp 114 is positioned furthest to the left from the clamp shaft 110. In this state, a left wire passage 134 through which the wire W can pass is defined between the downward protrusion 114*c* of the left clamp 114 and the flat-plate portion 110*a* of the clamp shaft 110. This state of the left clamp 114 is termed a fully-open state. When the outer sleeve 106 is moved forward with respect to the clamp shaft 110 in that state, the left clamp 114 is moved rightward toward the clamp shaft 110. The wire W can still pass through the left wire passage 134 in this state, while a rear end of the left wire passage 134 is covered by the rear guard 114*e* and a front end of the left wire passage 134 is covered by the front guard 114*f*. This state of the left clamp 114 is termed a half-open state. When the outer sleeve 106 is moved further forward with respect to the clamp shaft 110, the left clamp 114 is moved further rightward toward the clamp shaft 110. In this state, the wire W is held between an upper end of the contact portion 114*d* of the left clamp 114 and a lower end of the flat-plate portion 110*a* of the clamp shaft 110. This state of the left clamp 114 is termed a fully-closed state.

On the way from the feeding unit 38 (see FIG. 6) to the guiding unit 40 (see FIG. 6), the wire W passes through the left wire passage 134 before reaching the guiding unit 40. Thus, when the wire W is cut by the cutter unit 44 (see FIG. 6) with the left clamp 114 in the fully-closed state, a proximal end of the wire W wound around the rebars R is held by the left clamp 114 and the clamp shaft 110.

Further, the wire W guided through the guiding unit 40 passes through the right wire passage 132. Thus, when the right clamp 112 is brought into the fully-closed state, a distal end of the wire W wound around the rebars R is held by the right clamp 112 and the clamp shaft 110.

Figure 16:
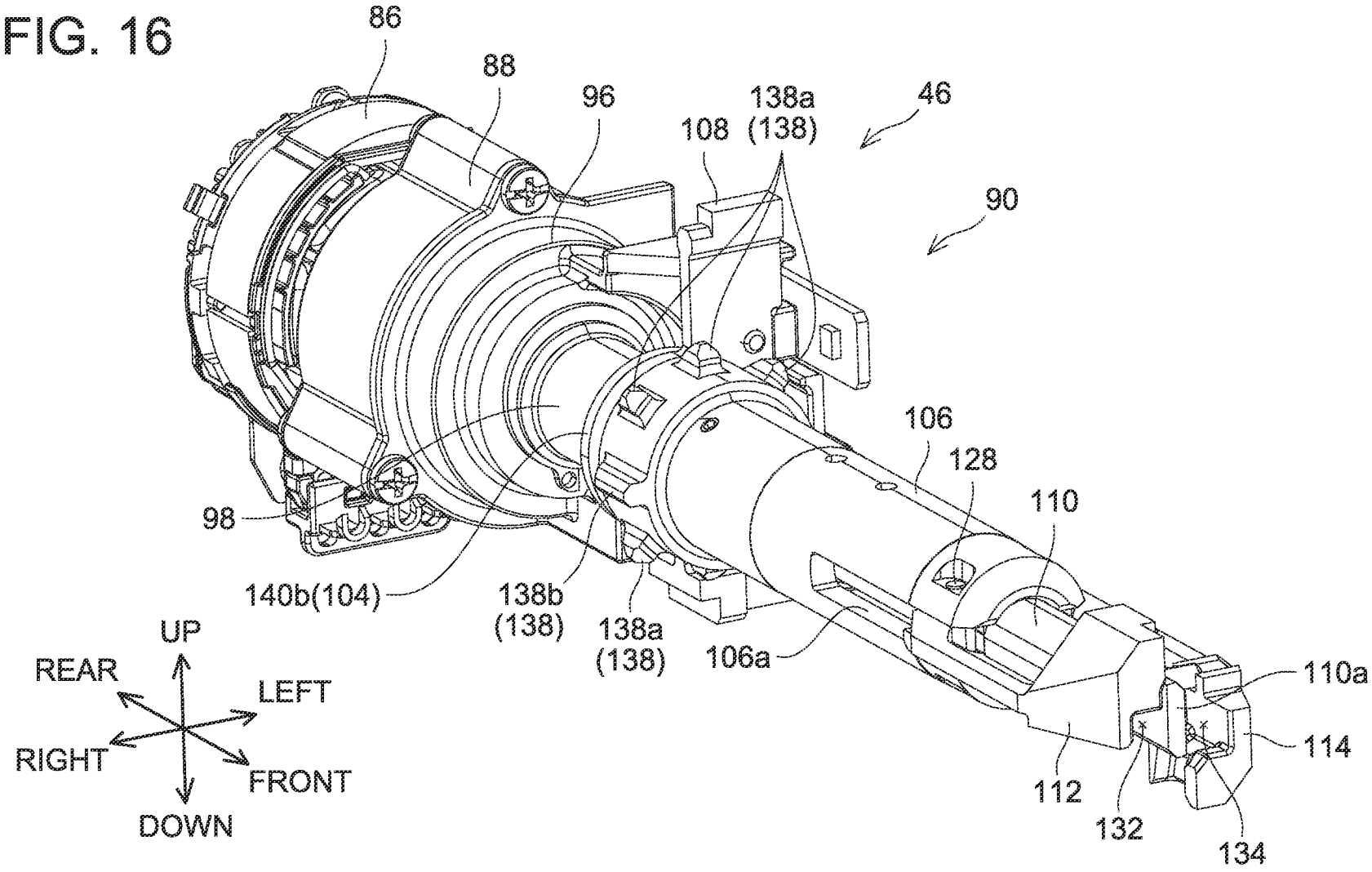
FIG. 16 is a perspective view of the twisting motor 86, the reducer 88, and the retainer 90 according to the first embodiment.

As shown in FIG. 16, the outer sleeve 106 includes fins 138 on an outer surface of its rear portion. The fins 138 extend in the front-rear direction. In the present embodiment, eight fins 138 are arranged on the outer surface of the outer sleeve 106 with intervals of 45 degrees from each other. Further, in the present embodiment, the eight fins 138 comprise seven short fins 138*a* and one long fin 138*b*. A length of the long fin 138*b* in the front-rear direction is greater than a length of the short fins 138*a* in the front-rear direction. In the front-rear direction, the position of a rear end of the long fin 138*b* is coincident with the positions of rear ends of the short fins 138*a*. In the front-rear direction, the position of a front end of the long fin 138*b* is forward of the positions of front ends of the short fins 138*a*.

Figure 17:
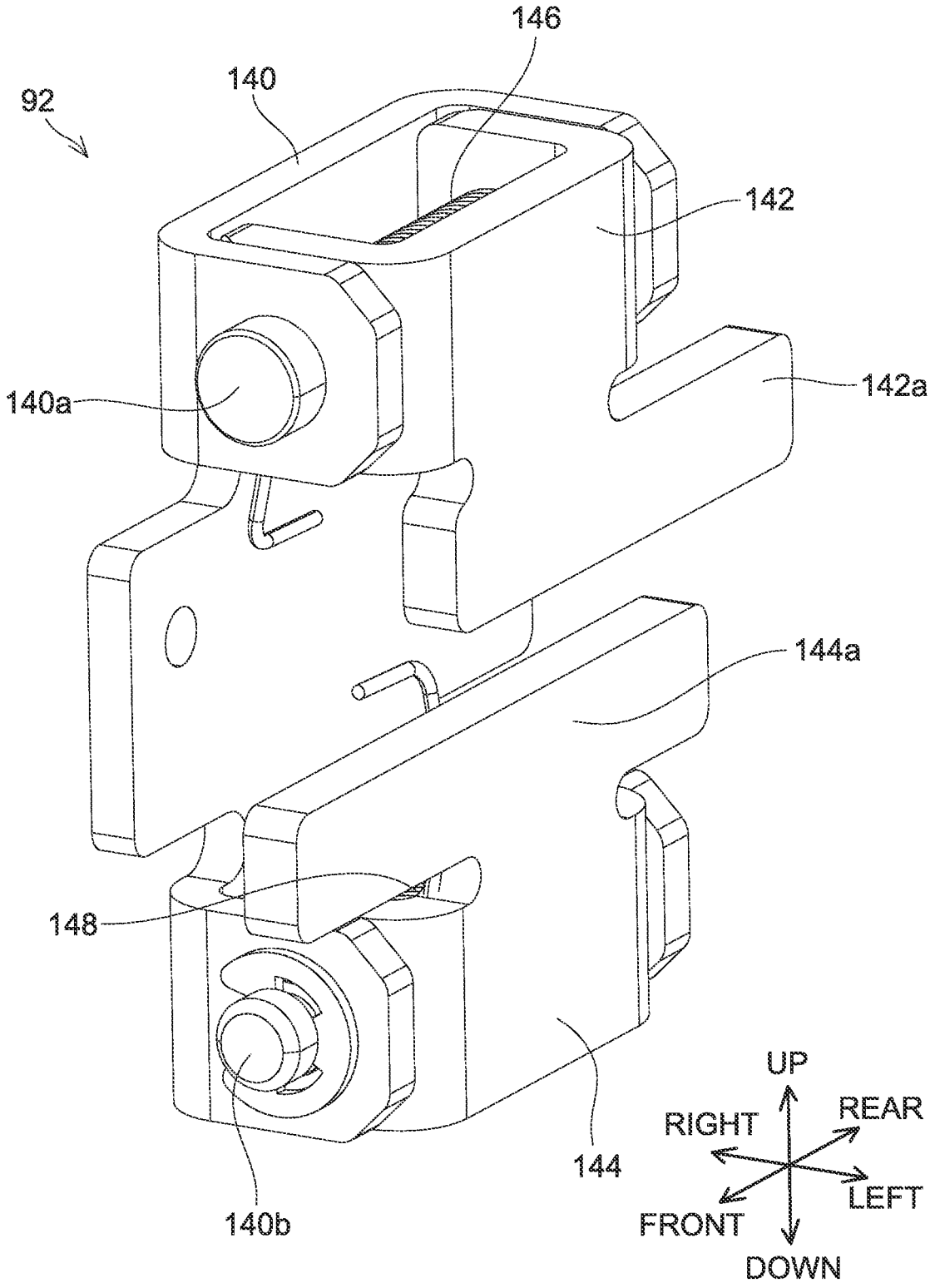
FIG. 17 is a perspective view of a rotation restrictor 92 according to the first embodiment.

The rotation restrictor 92 is disposed corresponding to the fins 138 of the outer sleeve 106. The rotation restrictor 92 is configured to permit or prohibit the rotation of the outer sleeve 106 in cooperation with the fins 138. As shown in FIG. 17, the rotation restrictor 92 comprises a base 140, an upper stopper 142, a lower stopper 144, and torsion springs 146, 148. The base 140 is fixed to the right housing 18 (see FIG. 1). The upper stopper 142 is swingably supported by an upper portion of the base 140 via a swing shaft 140*a*. The upper stopper 142 comprises a restriction piece 142*a*. The restriction piece 142*a* is disposed at a lower portion of the upper stopper 142. The torsion spring 146 biases the restriction piece 142*a* in an outwardly opening direction (i.e., in a direction that brings the restriction piece 142*a* away from the base 140). The lower stopper 144 is swingably supported by a lower portion of the base 140 via a swing shaft 140*b*. The lower stopper 144 comprises a restriction piece 144*a*. The restriction piece 144*a* is disposed at an upper portion of the lower stopper 144. A rear end of the restriction piece 144*a* is positioned forward of a rear end of the restriction piece 142*a*. The torsion spring 148 biases the restriction piece 144*a* in an outwardly opening direction (i.e., in a direction that brings the restriction piece 144*a* away from the base 140).

When the screw shaft 102 (see FIG. 10) is rotated counterclockwise as viewed from the rear by the twisting motor 86 (see FIG. 10) rotating forward, the rotation of the outer sleeve 106 is prohibited by the upper stopper 142 upon the restriction piece 142*a* contacting one of the fins 138 (see FIG. 16) of the outer sleeve 106. To the contrary, when the screw shaft 102 is rotated clockwise as viewed from the rear by the twisting motor 86 rotating in reverse, one of the fins 138 of the outer sleeve 106 contacts the restriction piece 142*a* and pushes in the restriction piece 142*a*. In this case, the upper stopper 142 does not prohibit the rotation of the outer sleeve 106.

When the screw shaft 102 is rotated counterclockwise as viewed from the rear by the twisting motor 86 rotating forward, one of the fins 138 of the outer sleeve 106 contacts the restriction piece 144*a* of the lower stopper 144 and pushes in the restriction piece 144*a*. In this case, the lower stopper 144 does not prohibit the rotation of the outer sleeve 106. To the contrary, when the screw shaft 102 is rotated clockwise as viewed from the rear, the rotation of the outer sleeve 106 is prohibited by the lower stopper 144 upon the restriction piece 144*a* contacting one of the fins 138 of the outer sleeve 106.

Next, operation of the rebar tying tool 2 shown in FIG. 1 will be described. The rebar tying tool 2 performs a tying operation when the trigger 12 is operated by the operator. During the tying operation by the rebar tying tool 2, a feeding process, a distal end retaining process, a pull-back process, a proximal end retaining process, a cutting process, a twisting process, and a returning process are performed.

(Feeding Process)

When the feeding motor 50 shown in FIG. 4 rotates forward (that is, rotates in the direction D1 shown in FIG. 4) in the initial state of the rebar tying tool 2, the feeding unit 38 feeds out the wire W on the reel 33 by a predetermined length. The distal end of the wire W passes through the fixed cutter 72, the movable cutter 74, the left wire passage 134, the guiding unit 40, and the right wire passage 132 in this order. As a result, the wire W is wound around the rebars R in a loop shape. The feeding motor 50 is stopped upon completion of the feed-out of the wire W.

(Distal End Retaining Process)

When the twisting motor 86 shown in FIG. 10 rotates forward after the completion of the feeding process, the screw shaft 102 rotates counterclockwise. At this occasion, the outer sleeve 106 is prohibited from rotating counterclockwise by the rotation restrictor 92. Thus, the outer sleeve 106 moves forward together with the inner sleeve 104 with respect to the clamp shaft 110, the right clamp 112 is brought into the fully-closed state, and the left clamp 114 is brought into the half-open state. The distal end of the wire W is thereby retained by the right clamp 112 and the clamp shaft 110. The twisting motor 86 is stopped when the retention of the distal end of the wire W is detected.

(Pull-Back Process)

When the feeding motor 50 shown in FIG. 4 rotates in reverse (that is, in the direction D2 shown in FIG. 4) after the completion of the distal end retaining process, the feeding unit 38 pulls back the wire W wound around the rebars R. Since the distal end of the wire W is retained by the right clamp 112 and the clamp shaft 110, the diameter of the loop formed by the wire W around the rebars R is decreased. The feeding motor 50 is stopped upon completion of the pull-back of the wire W.

(Proximal End Retaining Process)

When the twisting motor 86 shown in FIG. 10 rotates forward after the completion of the pull-back process, the screw shaft 102 rotates counterclockwise. At this occasion, the outer sleeve 106 is prohibited from rotating counterclockwise by the rotation restrictor 92. Thus, the outer sleeve 106 further moves forward together with the inner sleeve 104 with respect to the clamp shaft 110 and the left clamp 114 is brought into the fully-closed state. The proximal end of the wire W is thereby retained by the left clamp 114 and the clamp shaft 110.

(Cutting Process)

Figure 8:
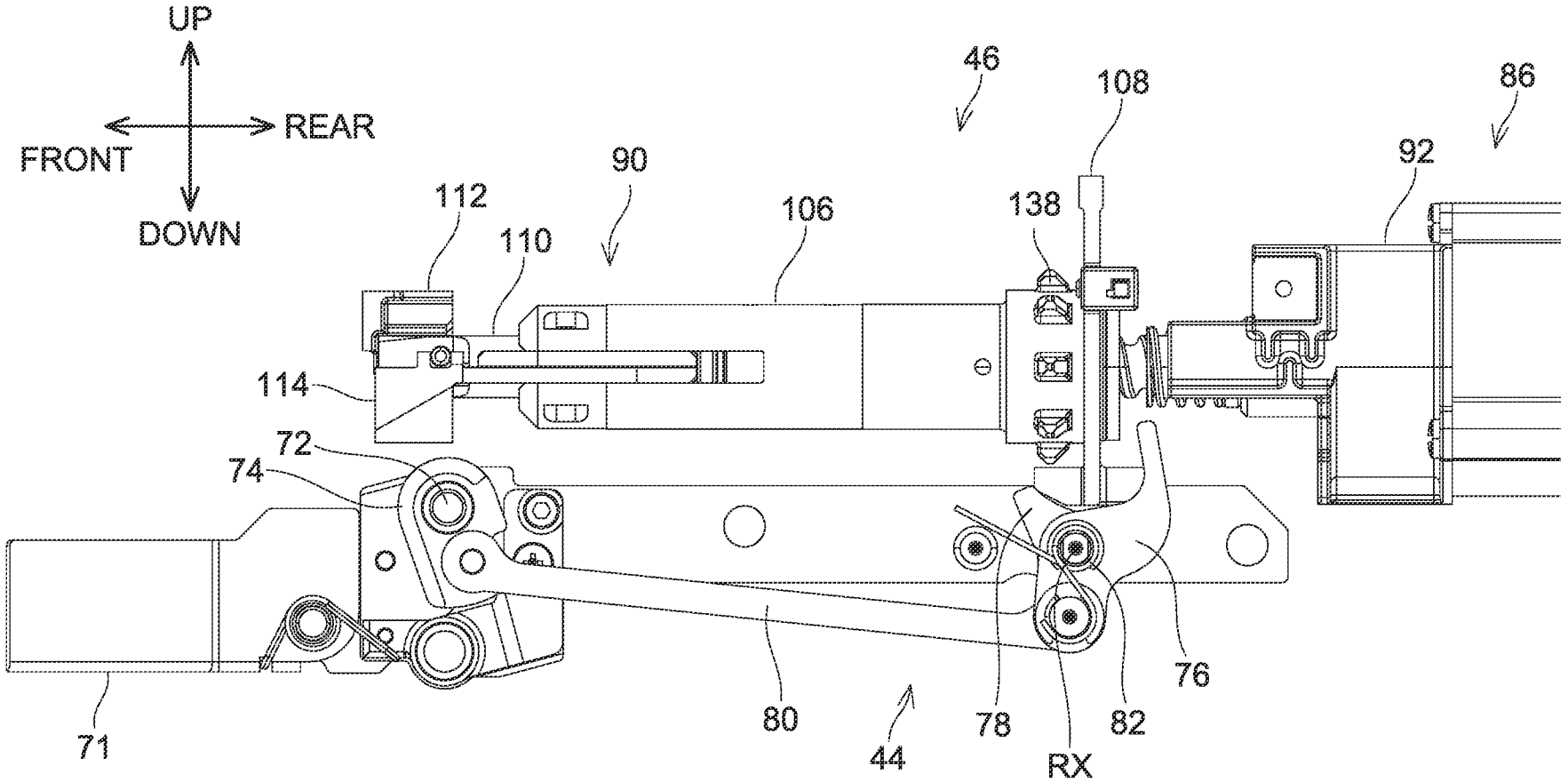
FIG. 8 is a side view of the cutter unit 44 according to the first embodiment, illustrating a state after the first lever 76 and the second lever 78 has pivoted.

When the twisting motor 86 shown in FIG. 10 further rotates forward after the completion of the proximal end retaining process, the screw shaft 102 rotates counterclockwise. At this occasion, the outer sleeve 106 is prohibited from rotating counterclockwise by the rotation restrictor 92. Thus, the outer sleeve 106 further moves forward together with the inner sleeve 104 with respect to the clamp shaft 110 and the push plate 108 pushes the upper end of the second lever 78 forward as shown in FIG. 8. As a result, the wire W is cut by the fixed cutter 72 and the movable cutter 74. The twisting motor 86 is stopped upon completion of the cutting of the wire W.

(Twisting Process)

When the twisting motor 86 shown in FIG. 10 further rotates forward after the completion of the cutting process, the screw shaft 102 rotates counterclockwise. At this occasion, the outer sleeve 106 is permitted to rotate counterclockwise by the rotation restrictor 92. Thus, the outer sleeve 106, the inner sleeve 104, the clamp shaft 110, the right clamp 112, and the left clamp 114 integrally rotate counterclockwise. The wire W wound around the rebars R is thereby twisted. The twisting motor 86 is stopped upon completion of the twisting of the wire W.

(Returning Process)

When the twisting motor 86 shown in FIG. 10 rotates in reverse after the completion of the twisting process, the screw shaft 102 rotates clockwise. At this occasion, the outer sleeve 106 is prohibited from rotating clockwise by the rotation restrictor 92. Thus, the outer sleeve 106 moves rearward together with the inner sleeve 104 with respect to the clamp shaft 110, the left clamp 114 is brought into the fully-open state through the half-open state, and the right clamp 112 is brought into the fully-open state. Thereafter, when the clockwise rotation is permitted by the rotation restrictor 92, the outer sleeve 106, the inner sleeve 104, the clamp shaft 110, the right clamp 112, and the left clamp 114 integrally rotate clockwise. When the long fin 138*b* contacts the lower stopper 144, the rotation of the outer sleeve 106 is prohibited again and thus the outer sleeve 106 moves rearward again together with the inner sleeve 104 with respect to the clamp shaft 110. The twisting motor 86 is stopped when the return of the twisting unit 46 to the initial state is detected.

For the rebar tying tool 2, the thickness of the wire W varies depending on diameters of rebars R to be used. Further, depending on the environment in which the rebars R are used, etc., a wire W coated by a coat (e.g., a resin material) or a plated wire W can be used. The type of the reel 33 (see FIG. 18) varies depending on the thickness of wire W, whether the wire W is coated or not, and/or whether the wire W is plated or not. Thus, the rebar tying tool 2 comprises a type detecting mechanism 158 (see FIG. 18) for detecting the type of the reel 33.

Figure 18:
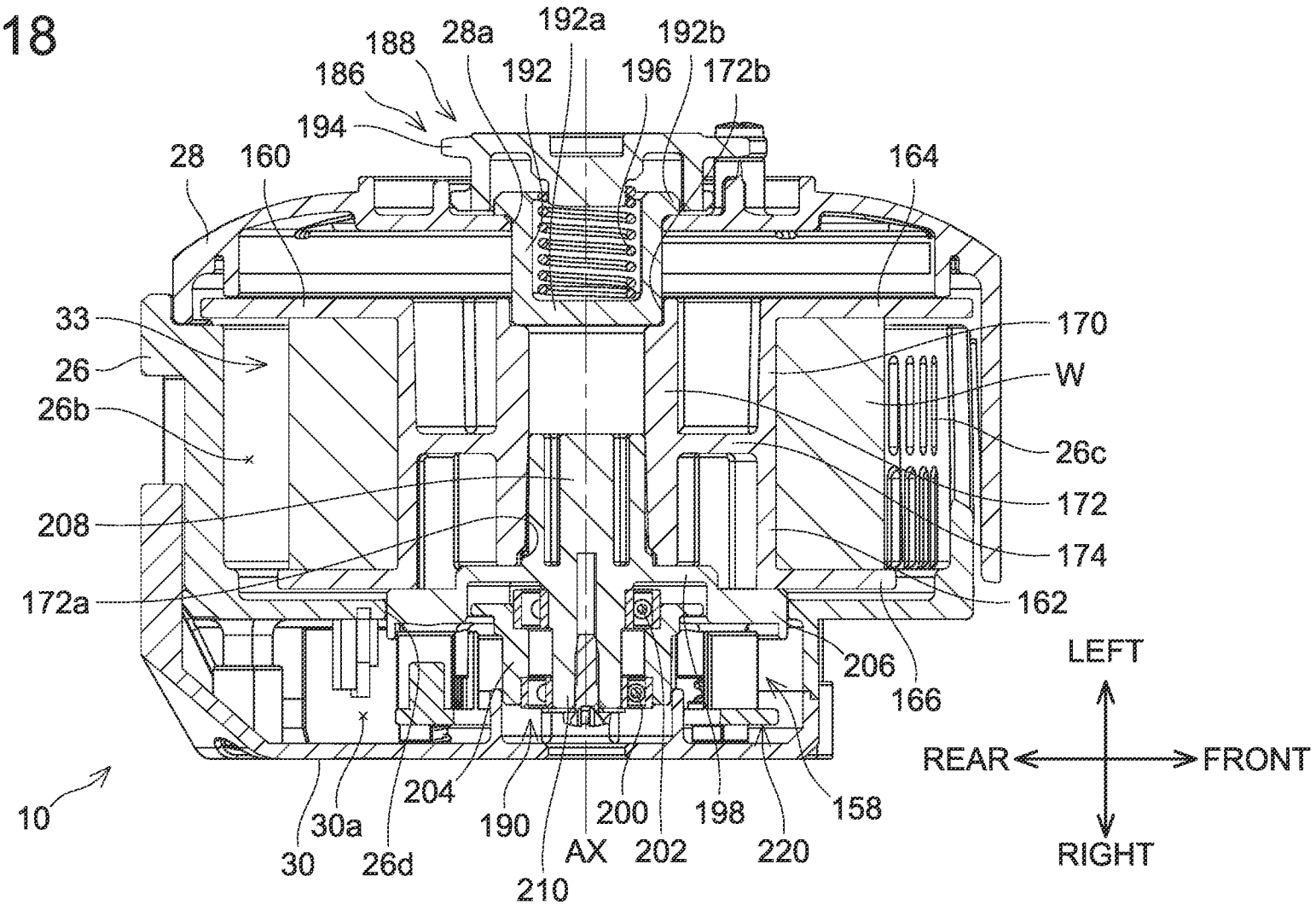
FIG. 18 is a cross-sectional view of the reel holder 10 and a reel 33 according to the first embodiment.

First, the reel 33 will be described. As shown in FIG. 18, the reel 33 is disposed in the housing space 26*b* of the reel holder 10. The reel 33 is supported by the reel holder 10 such that the reel 33 is rotatable about a rotation axis AX extending in the right-left direction. The reel 33 comprises a bobbin 160 and the wire W. The central axis of the bobbin 160 is coincident with the rotation axis AX of the reel 33.

Figure 19:
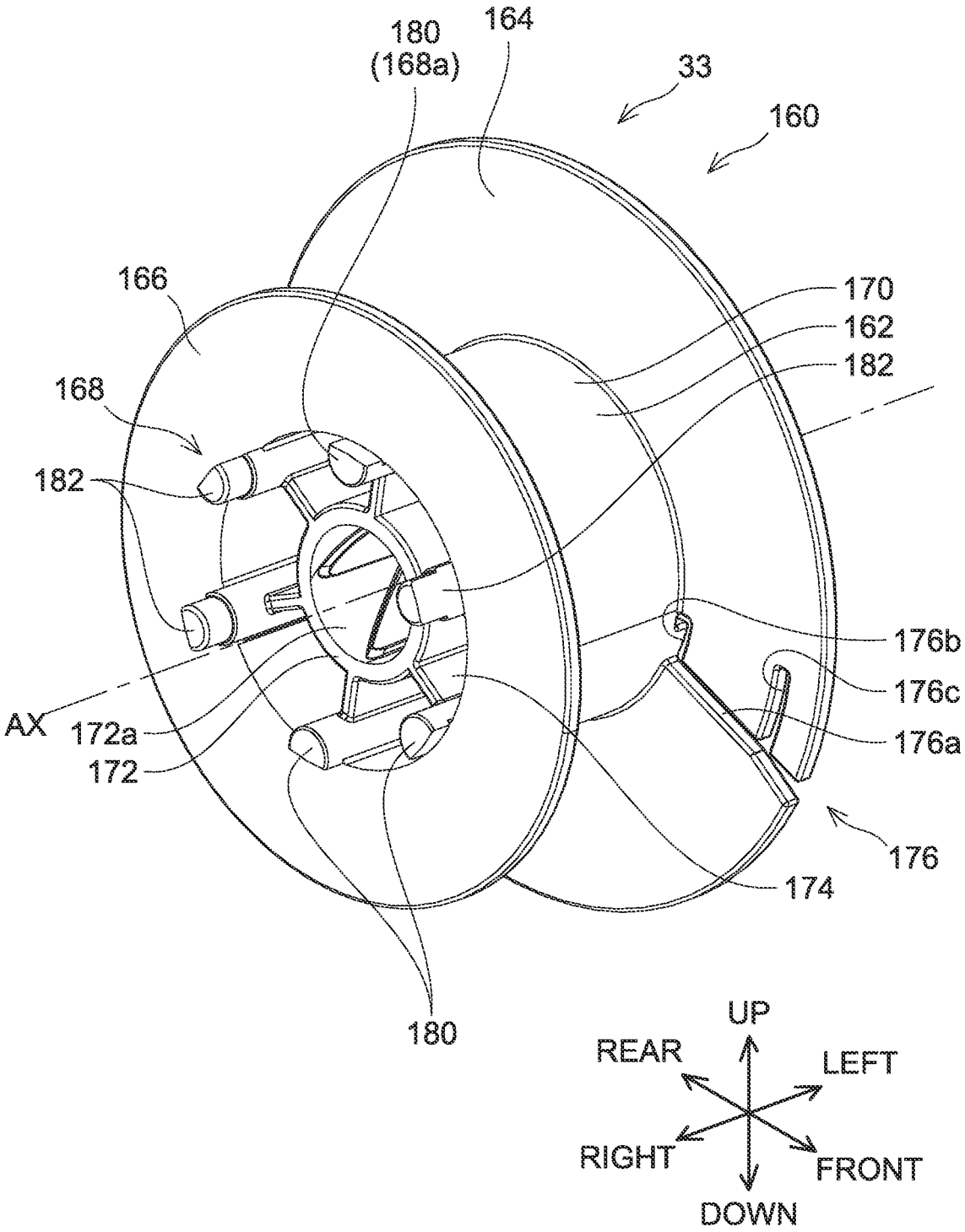
FIG. 19 is a perspective view of a bobbin 160 of the reel 33 according to the first embodiment.

As shown in FIG. 19, the bobbin 160 comprises a trunk 162, a pair of flanges 164, 166, and a plurality of projections 168 (six projections 168 in the present embodiment). Hereinafter, the pair of flanges 164, 166 may be separately termed a left flange 164 and a right flange 166. For example, the trunk 162, the pair of flanges 164, 166, and the six projections 168 are constituted of a resin material. The trunk 162, the pair of flanges 164, 166, and the six projections 168 are integral with each other.

The trunk 162 comprises an outer cylinder 170, an inner cylinder 172, and a connection 174. The outer cylinder 170 and the inner cylinder 172 have substantially cylindrical shapes. The wire W (see FIG. 18) is wound around an outer circumferential surface of the outer cylinder 170 in multiple layers. The inner cylinder 172 is disposed inside the outer cylinder 170. As shown in FIG. 18, an engagement groove 172*a* is defined in a right end portion of an inner circumferential surface of the inner cylinder 172. A shaft receiving groove 172*b* is defined in a left end portion of the inner circumferential surface of the inner cylinder 172. The connection 174 is disposed between an inner circumferential surface of the outer cylinder 170 and an outer circumferential surface of the inner cylinder 172. The connection 174 connects the outer cylinder 170 to the inner cylinder 172.

As shown in FIG. 19, the left flange 164 and the right flange 166 have broad disk shapes. The wire W (see FIG. 18) is disposed between the left flange 164 and the right flange 166. The left flange 164 is disposed at a left end of the trunk 162. The left flange 164 extends radially outward from the outer circumferential surface of the outer cylinder 170. The left flange 164 includes a lock groove 176 penetrating the left flange 164 in its thickness direction (in the right-left direction). The lock groove 176 comprises a guide portion 176*a* extending from an inner circumferential surface of the left flange 164 to an outer circumferential surface thereof, a base end locking portion 176*b* connected to the guide portion 176*a* near the inner circumferential surface of the left flange 164, and a terminal end locking portion 176*c* connected to the guide portion 176*a* near the outer circumferential surface of the left flange 164. One end of the wire W wound around the outer cylinder 170 is locked to the left flange 164 at the base end locking portion 176*b*. The other end of the wire W wound around the outer cylinder 170 is locked to the left flange 164 at the terminal end locking portion 176*c*.

The right flange 166 is disposed at a right end of the trunk 162. The right flange 166 extends radially outward from the outer circumferential surface of the outer cylinder 170. The diameter of the outer circumferential surface of the right flange 166 is smaller than the diameter of the outer circumferential surface of the left flange 164.

The six projections 168 extend outward (rightward) along the rotation axis AX of the reel 33, beyond an outer surface (right surface) of the right flange 166, from between the inner circumferential surface of the outer cylinder 170 and the outer circumferential surface of the inner cylinder 172. The projections 168 each have a substantially semicircular column shape formed by dividing a cylindrical column into two. The six projections 168 are arranged at regular intervals around the rotation axis AX of the reel 33 (along a rotation direction of the reel 33). In the present embodiment, adjacent projections 168 are arranged at intervals corresponding to an angle of 60 degrees around the rotation axis AX of the reel 33.

The six projections 168 comprise three short projections 180 and three long projections 182. A length of the long projections 182 in their longitudinal direction is greater than a length of the short projections 180 in their longitudinal direction. The long projections 182 extend farther away from the outer surface (right surface) of the right flange 166 than the short projections 180 do. Starting from one projection 168 (which is termed a reference projection 168*a*) among the six projections 168, the three short projections 180 are arranged at a position of 0 degree, at a position of 120 degrees, and at a position of 180 degrees along the rotation direction of the reel 33. Further, starting from the reference projection 168*a*, the three long projections 182 are arranged at a position of 60 degrees, at a position of 240 degrees, and a position of 300 degrees along the rotation axis of the reel 33.

The number of the short projections 180, the number of the long projections 182, and the arrangement of the short projections 180 and the long projections 182 vary depending on types of reels 33. For example, in a reel 33 of another type, the six projections 168 comprise two short projections 180 and four long projections 182. Starting from the reference projection 168*a*, the two short projections 180 are arranged at the position of 0 degree and at the position of 180 degrees, and the four long projections 182 are arranged at the position of 60 degrees, at the position of 120 degrees, at the position of 240 degrees, and at the position of 300 degrees.

As shown in FIG. 18, the reel holder 10 further comprises a reel attaching part 186 for attaching the reel 33 such that the reel 33 is rotatable with respect to the reel holder 10. The reel attaching part 186 comprises a left reel attaching part 188 and a right reel attaching part 190.

The left reel attaching part 188 is attached to the main cover 28. The left reel attaching part 188 comprises a stopper 192, a cap 194, and a compression spring 196. The stopper 192 has a cylindrical shape and includes a bottom wall 192*a* at its right end. An insertion opening 28*a* is defined in the main cover 28 and the stopper 192 is inserted in the insertion opening 28*a* from the left. The stopper 192 comprises a flange 192*b* disposed at a left end of the stopper 192. The flange 192*b* can contact the main cover 28 from the left. Thereby, the stopper 192 is suppressed from falling out from the insertion opening 28*a* from the left toward the right. The cap 194 is fixed to a left surface of the main cover 28. The cap 194 suppresses the stopper 192 from falling out of the insertion opening 28*a* from the right toward the left. One end of the compression spring 196 is fixed to the cap 194 and the other end of the compression spring 196 is in contact with the bottom wall 192*a* of the stopper 192. When the main cover 28 is in the closed state with respect to the holder housing 26 and the reel 33 is in the housing space 26*b*, the compression spring 196 biases the stopper 192 toward the shaft receiving groove 172*b* defined in the inner cylinder 172 of the bobbin 160. The stopper 192 is received by the shaft receiving groove 172*b* and supports the inner cylinder 172 such that the inner cylinder 172 is slidable.

The right reel attaching part 190 comprises a turntable 198, bearings 200, 202, and a ring member 204.

Figure 20:
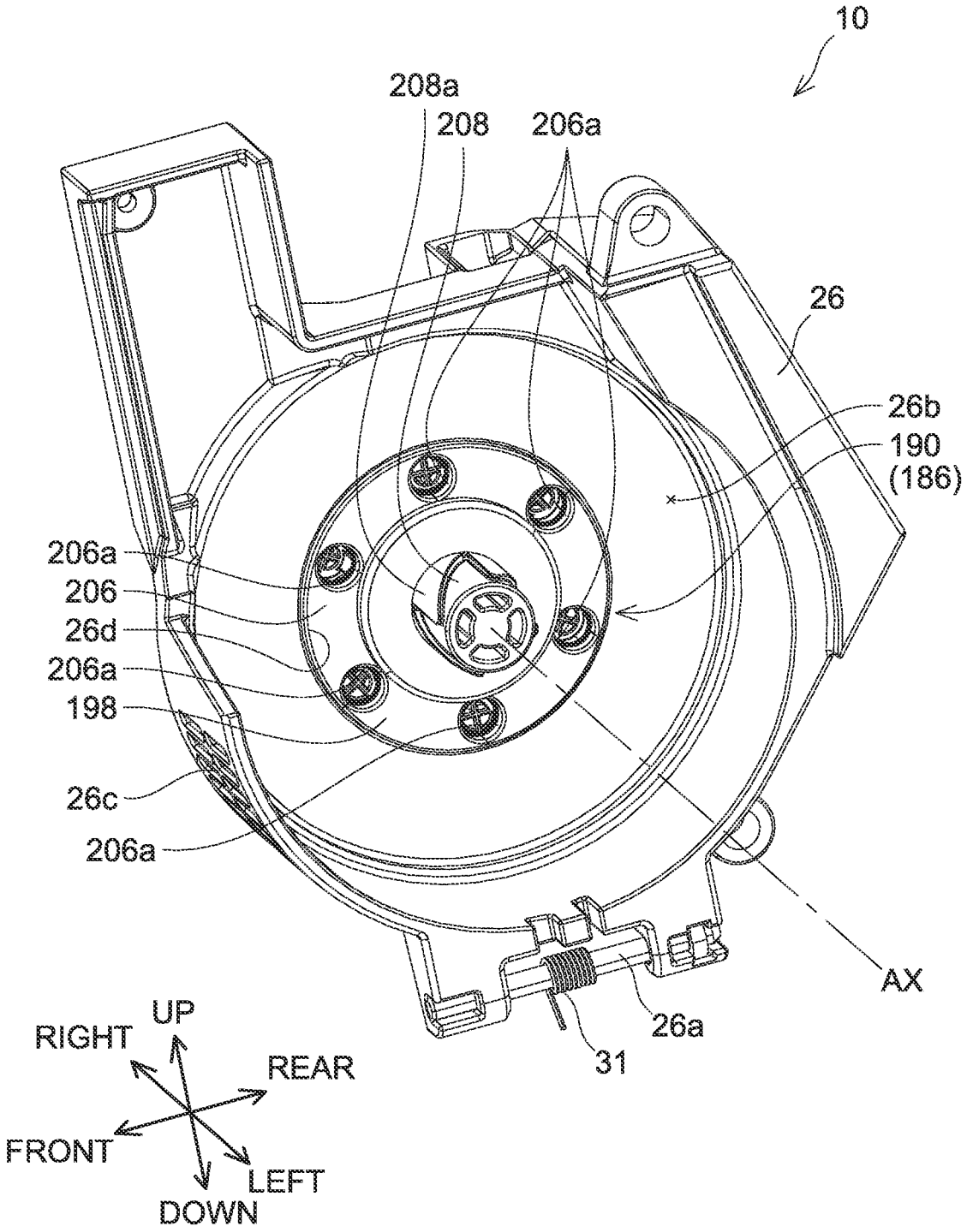
FIG. 20 is a perspective view of the reel holder 10 according to the first embodiment, illustrating a state where a main cover 28 is removed.

An insertion opening 26*d* is defined in a right surface of the holder housing 26 and the turntable 198 is inserted in the insertion opening 26*d*. In the insertion opening 26*d*, the turntable 198 is spaced from the holder housing 26. The turntable 198 is rotatable about a rotation axis extending in the right-left direction. The rotation axis of the turntable 198 is coincident with the rotation axis AX of the reel 33. The turntable 198 comprises a turntable body 206, an engagement member 208, and a shaft 210. The turntable body 206 has a substantially circular disk shape. As shown in FIG. 20, the turntable body 206 comprises a plurality of receivers 206*a* (six receivers 206*a* in the present embodiment). The number of the receivers 206*a* is equal to the number of the projections 168. The receivers 206*a* are circular in cross section. The receivers 206*a* penetrate the turntable body 206 in its thickness direction. The six receivers 206*a* are arranged at regular intervals around the rotation axis AX of the reel 33 (along the rotation direction of the reel 33). In the present embodiment, adjacent receivers 206*a* are arranged at intervals corresponding to an angle of 60 degrees around the rotation axis AX of the reel 33.

The engagement member 208 has a substantially cylindrical shape. The engagement member 208 extends leftward from a left surface of the turntable body 206. The engagement member 208 includes an engagement wall 208*a* around its outer circumferential surface. As shown in FIG. 18, when the reel 33 is in the housing space 26*b*, the engagement member 208 is inserted in the inner cylinder 172 of the bobbin 160 from the right. In this state, the engagement wall 208*a* (see FIG. 20) is engaged with the engagement groove 172*a* of the inner cylinder 172. The reel 33 is thus fixed to the turntable 198.

The shaft 210 extends rightward from a right surface of the turntable body 206. The shaft 210 has a substantially cylindrical shape.

Figure 21:
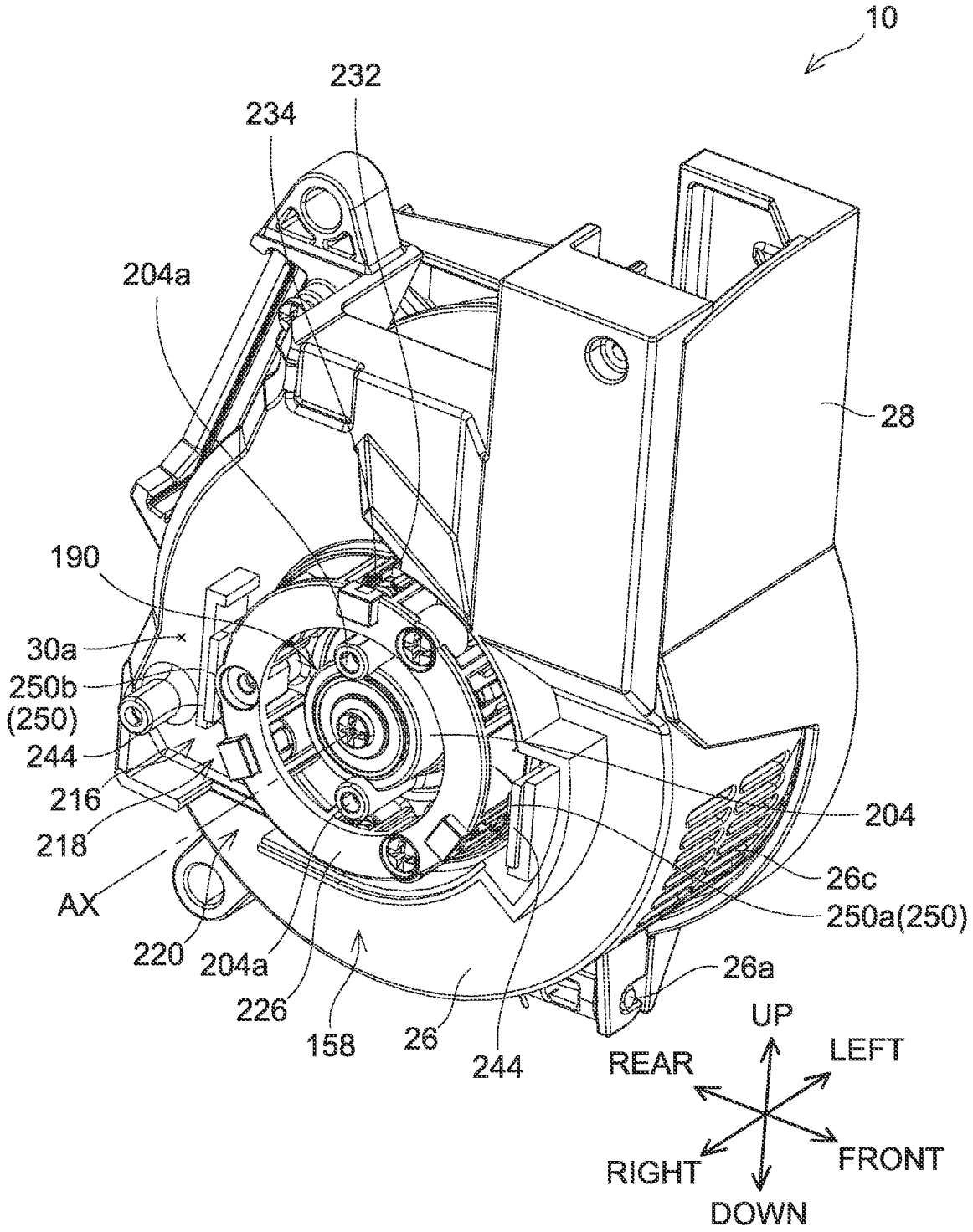
FIG. 21 is a perspective view of the reel holder 10 according to the first embodiment, illustrating a state where an auxiliary cover 30 is removed.

The ring member 204 is disposed in the auxiliary space 30*a*. The ring member 204 surrounds an outer circumferential surface of the shaft 210 in its circumferential direction. The ring member 204 supports the shaft 210 via the bearings 200, 202 such that the shaft 210 is rotatable. As shown in FIG. 21, the ring member 204 includes two screw holes 204*a*. The ring member 204 is fixed to the auxiliary cover 30 (see FIG. 18) by screws (not shown) being screwed in the screw holes 204*a*. Thus, the turntable 198 is rotatably supported by the auxiliary cover 30 via the ring member 204 and the bearings 200, 202.

Next, the type detecting mechanism 158 will be described. As shown in FIG. 21, the type detecting mechanism 158 comprises a type detecting unit 216 and a rotation detecting unit 218. The type detecting unit 216 comprises a type detecting device 220 and a plurality of type-detecting magnetic sensors 222 (two type-detecting magnetic sensors 222 in the present embodiment) (see FIG. 25).

Figure 22:
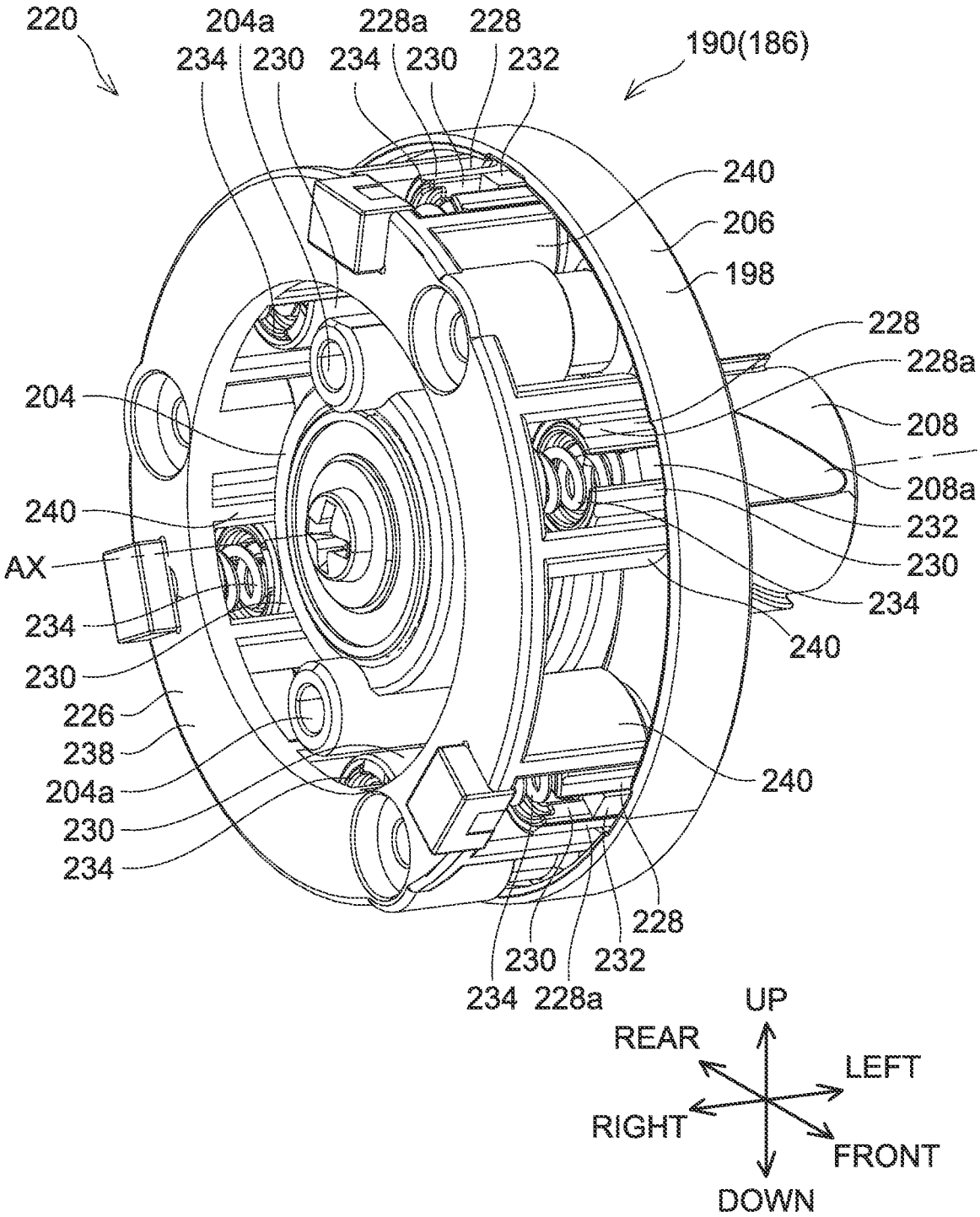
FIG. 22 is a perspective view of a right reel attaching part 190 and a type detecting device 220 according to the first embodiment.

As shown in FIG. 22, the type detecting device 220 is fixed to the turntable 198. The type detecting device 220 comprises a cover member 226, a plurality of support members 228 (six support members 228 in the present embodiment), a plurality of movable members 230 (six movable members 230 in the present embodiment), a plurality of type-detecting magnets 232 (six type-detecting magnets 232 in the present embodiment), and a plurality of compression springs 234 (six compression springs 234 in the present embodiment).

Figure 23:
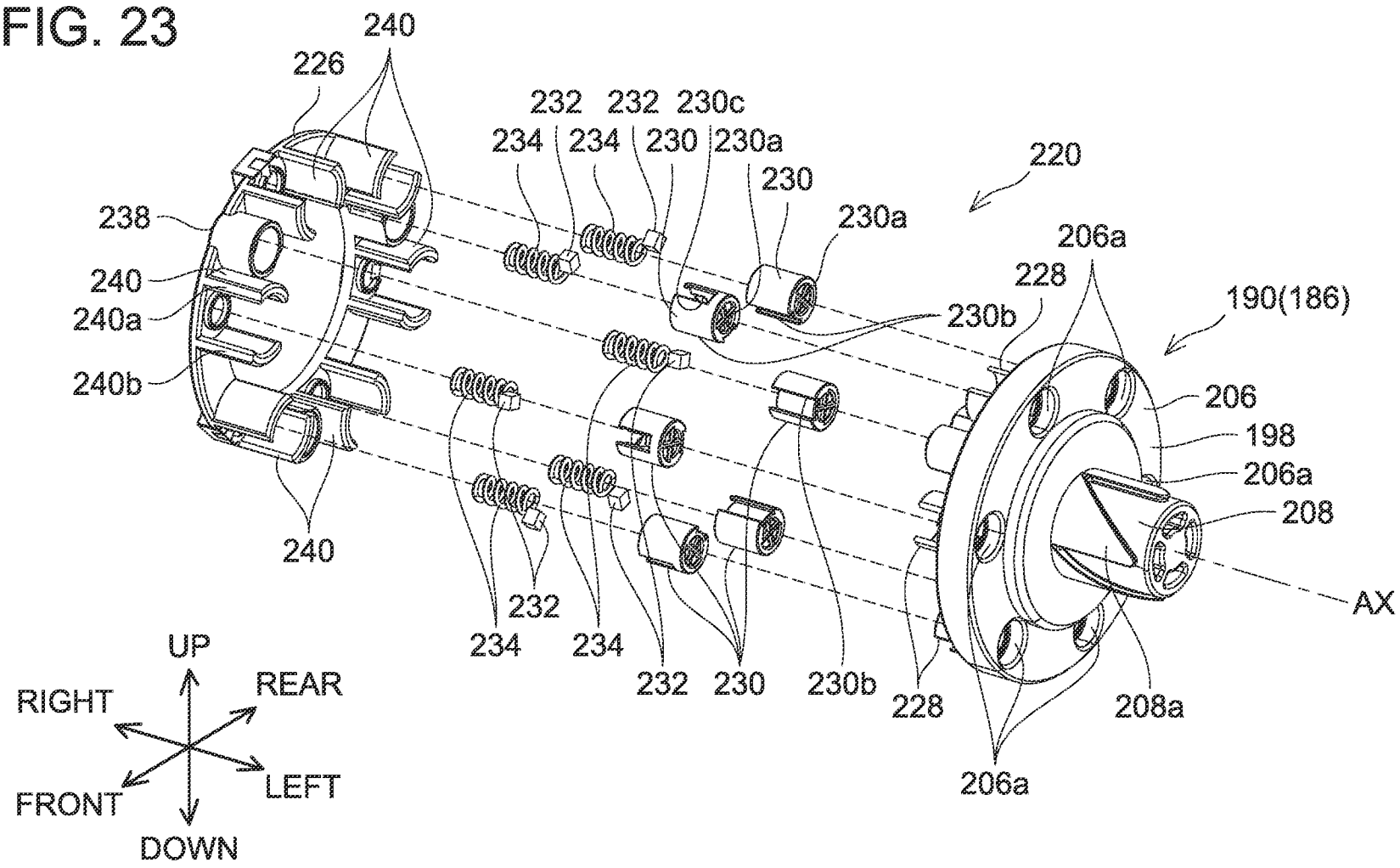
FIG. 23 is an exploded perspective view of a turntable 198 and the type detecting device 220 according to the first embodiment.

As shown in FIG. 23, the cover member 226 comprises a base 238 and a plurality of holding members 240 (six holding members 240 in the present embodiment). The base 238 has a circular disk shape and includes an opening at the center. The central axis of the base 238 is coincident with the rotation axis AX of the reel 33. The six holding members 240 extend leftward from a left surface of the base 238. The holding members 240 each comprise a pair of holding walls 240*a*, 240*b* opposing each other. The six holding members 240 are arranged at regular intervals around the rotation axis AX of the reel 33 (along the rotation direction of the reel 33). In the present embodiment, adjacent holding members 240 are arranged at intervals corresponding to an angle of 60 degrees around the rotation axis AX of the reel 33.

Figure 24:
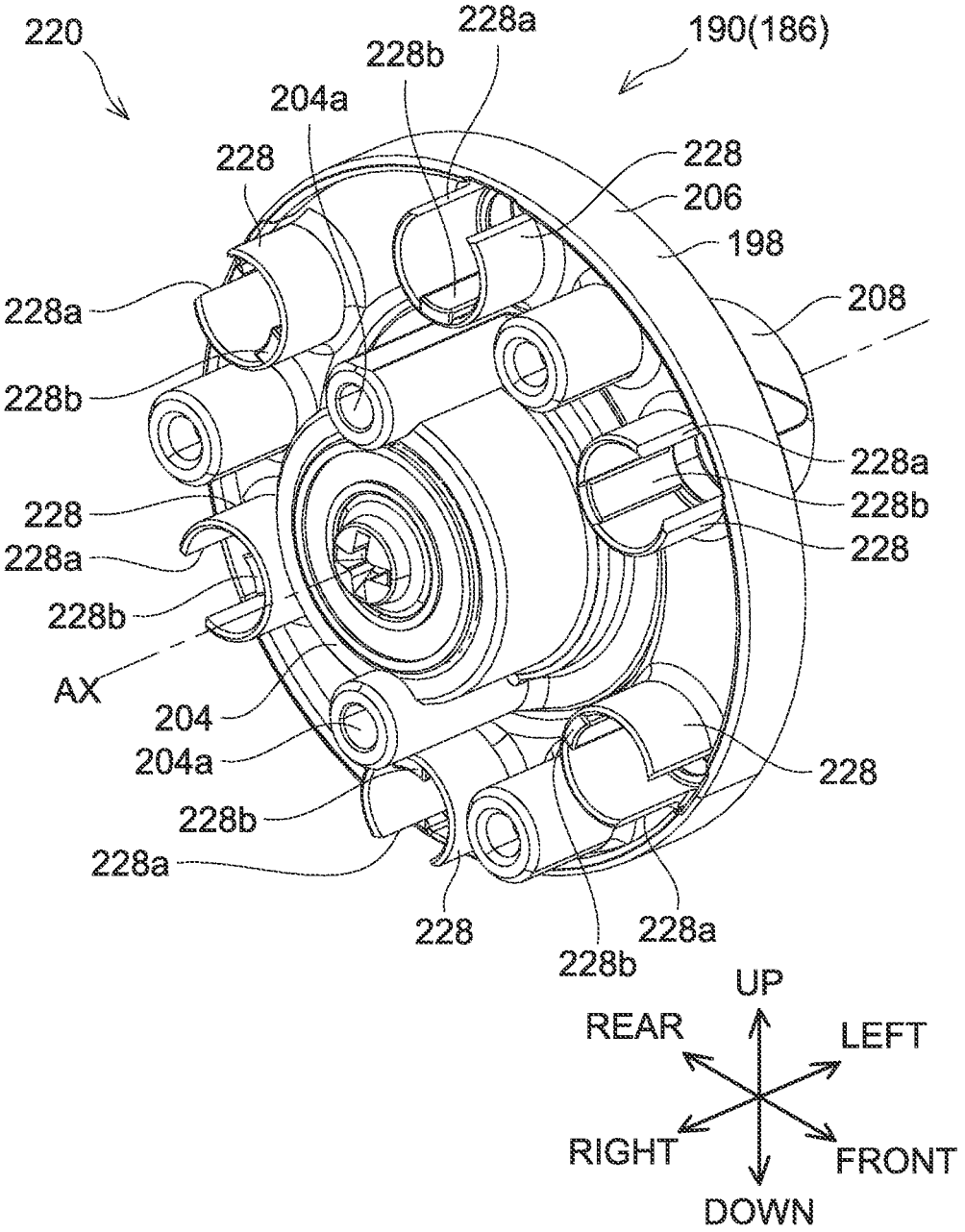
FIG. 24 is a perspective view of the right reel attaching part 190 and support members 228 according to the first embodiment.

As shown in FIG. 24 the six support members 228 are integral with the turntable 198. The six support members 228 extend rightward from the right surface of the turntable body 206. The support members 228 are disposed at peripheral edges of the receivers 206*a* (see FIG. 20) of the turntable body 206. The support members 228 have a cylindrical shape that is partially interrupted in the circumferential direction. The support members 228 each comprise a notch 228*a* corresponding to the partial interruption in the circumferential direction and an inner projection 228*b* opposing the notch 228*a*. The notches 228*a* are disposed outward of the inner projections 228*b* in a radial direction of the turntable body 206. The six support members 228 are arranged to surround the ring member 204. The six support members 228 are arranged at regular intervals around the rotation axis AX of the reel 33 (along the rotation direction of the reel 33). In the present embodiment, adjacent support members 228 are arranged at intervals corresponding to an angle of 60 degrees around the rotation axis AX of the reel 33.

The movable members 230 shown in FIG. 23 are supported by the support members 228 such that the movable members 230 are slidable in the right-left direction. The movable members 230 are disposed within the support members 228. The movable members 230 each have a substantially cylindrical shape and include a bottom wall 230*a* at its left end. The movable members 230 each include a receiver groove 230*b* extending from its right end toward the bottom wall 230*a* and a fixture groove 230*c*. The receiver groove 230*b* and the fixture groove 230*c* are arranged at intervals corresponding to an angle of 180 degrees in a circumferential direction of an outer circumferential surface of each movable member 230. The receiver grooves 230*b* receive the inner projections 228*b* (see FIG. 24) of the support members 228. Thus, the movable members 230 are suppressed from rotating. The type-detecting magnets 232 are fitted in the fixture grooves 230*c*. Thus, the type-detecting magnets 232 are fixed to the movable members 230.

Each compression spring 234 is disposed between the pair of holding walls 240*a*, 240*b* of its corresponding holding member 240. One end of each compression spring 234 is in contact with the base 238 and the other end thereof is in contact with the bottom wall 230*a* of its corresponding movable member 230. The compression springs 234 bias the movable members 230 in a direction away from the base 238 toward an initial position. Thus, the movable members 230 are slidable between the initial position and a specific position. Here, the initial position means the position of the movable members 230 in the state where the reel 33 is not attached in the reel holder 10.

Figure 25:
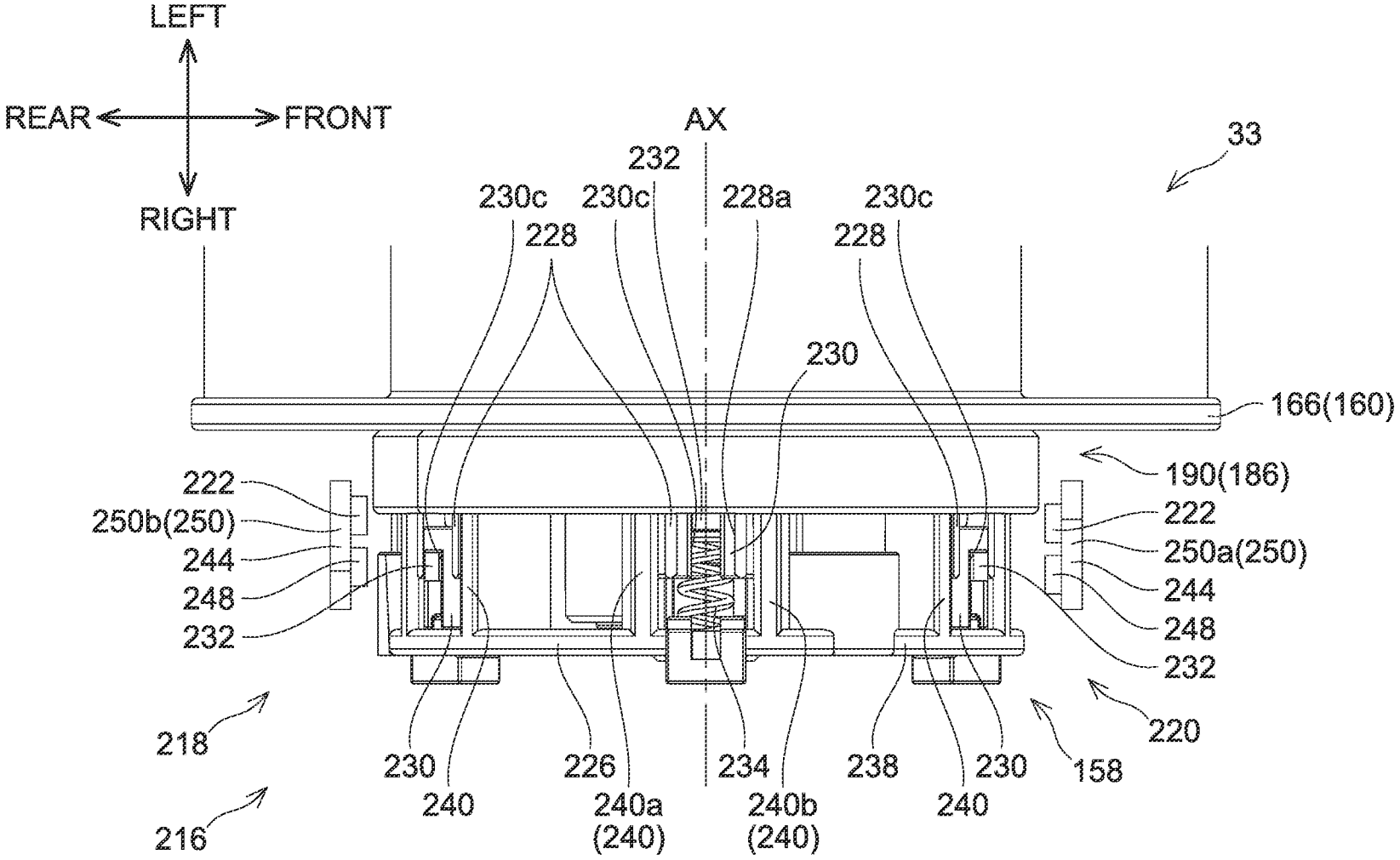
FIG. 25 is a top view of the reel 33, a type detecting mechanism 158, and the right reel attaching part 190 according to the first embodiment.

As shown in FIG. 25, the type-detecting magnetic sensors 222 are fixed to sensor substrates 244, respectively. The sensor substrates 244 face the type detecting device 220. The type-detecting magnetic sensors 222 are electrically connected to the control circuit board 36 (see FIG. 3) via wires which are not shown.

The rotation detecting unit 218 comprises a plurality of rotation-detecting magnetic sensors 248 (two rotation-detecting magnetic sensors 248 in the present embodiment). The rotation-detecting magnetic sensors 248 are fixed to the sensor substrate 244, respectively. Each rotation-detecting magnetic sensor 248 is aligned with corresponding type-detecting magnetic sensor 222 in a direction along the rotation axis AX of the reel 33. Hereinafter, the combination of a sensor substrate 244, a type-detecting magnetic sensor 222, and a rotation-detecting magnetic sensor 248 may be termed a detector 250. In the present embodiment, the type detecting mechanism 158 comprises a plurality of detectors 250 (two detectors 250). Hereinafter, one of the detectors 250 (e.g., the front detector 250 in FIG. 25) may be termed a detector 250*a*, and the other detector 250 (e.g., the rear detector 250 in FIG. 25) may be termed a detector 250*b*.

Figure 26:
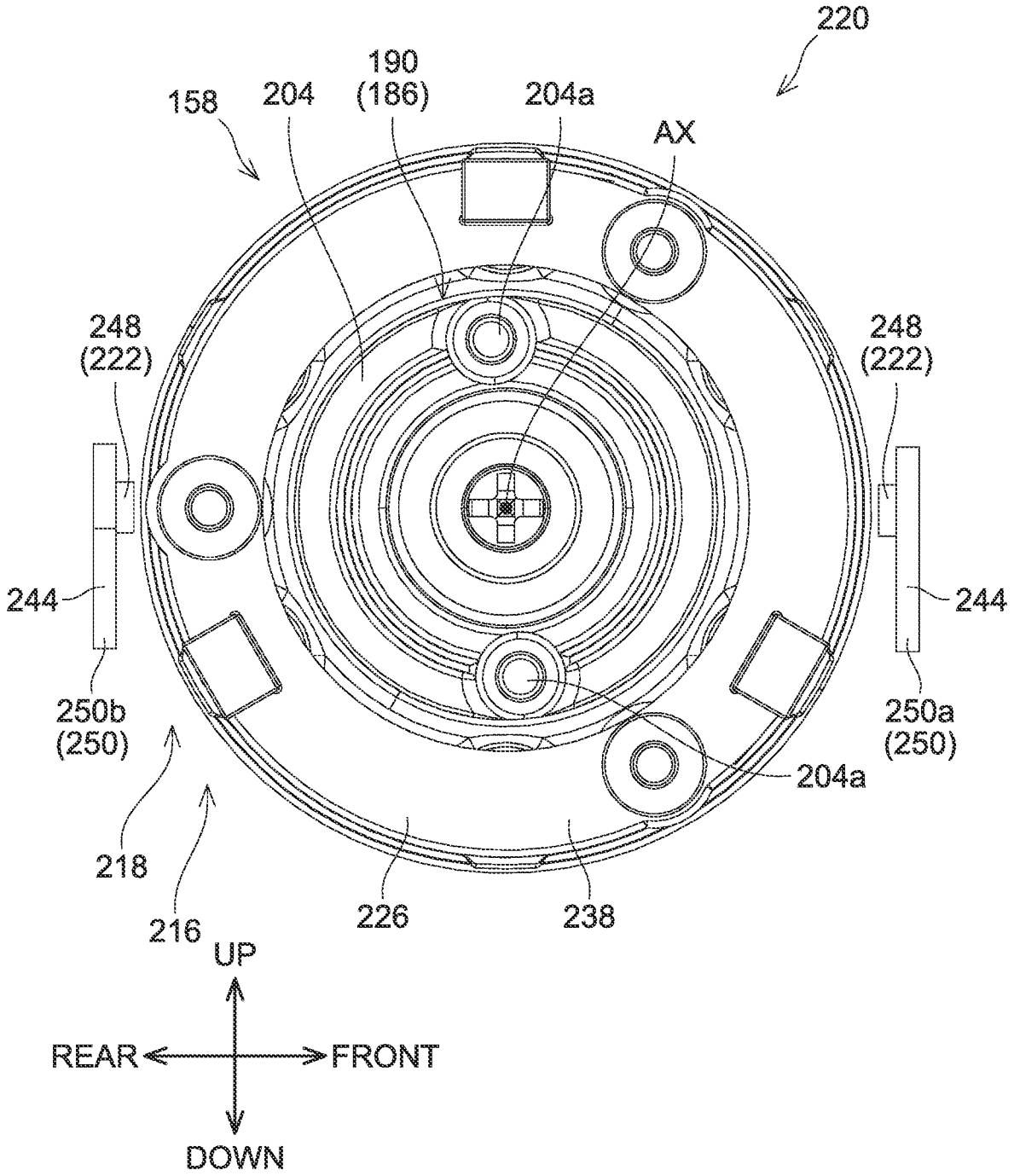
FIG. 26 is a right side view of the type detecting mechanism 158 and the right reel attaching part 190 according to the first embodiment.

As shown in FIG. 26, the two type-detecting magnetic sensors 222 are disposed at regular intervals along a rotation direction of the reel 33 (around the rotation axis AX of the reel 33). In the present embodiment, the two type-detecting magnetic sensors 222 are disposed at intervals corresponding to an angle of 180 degrees (360 degrees/two sensors) along the rotation direction of the reel 33. The two rotation-detecting magnetic sensors 248 are also disposed at regular intervals along the rotation direction of the reel 33. In the present embodiment, the two rotation-detecting magnetic sensors 248 are disposed at intervals corresponding to an angle of 180 degrees (360 degrees/two sensors) along the rotation direction of the reel 33.

Next, a method of detecting the type of the reel 33 will be described. First, in the state where the main cover 28 (see FIG. 18) of the reel holder 10 is open, the projections 168 (see FIG. 27) of the reel 33 are inserted into corresponding receivers 206*a* (see FIG. 27) of the turntable 198. Thus, the projections 168 engage with the receivers 206*a*. Then, the main cover 28 is closed and the lock lever 32 (see FIG. 1) is pivoted to maintain the main cover 28 in the closed state. As a result, as shown in FIG. 18, the engagement wall 208*a* (see FIG. 20) of the engagement member 208 of the turntable 198 engages with the engagement groove 172*a* and the stopper 192 is received into the shaft receiving groove 172*b* of the reel 33. In this way, the reel 33 is attached to the reel attaching part 186 such that the reel 33 is rotatable with respect to the holder housing 26.

Figure 27:
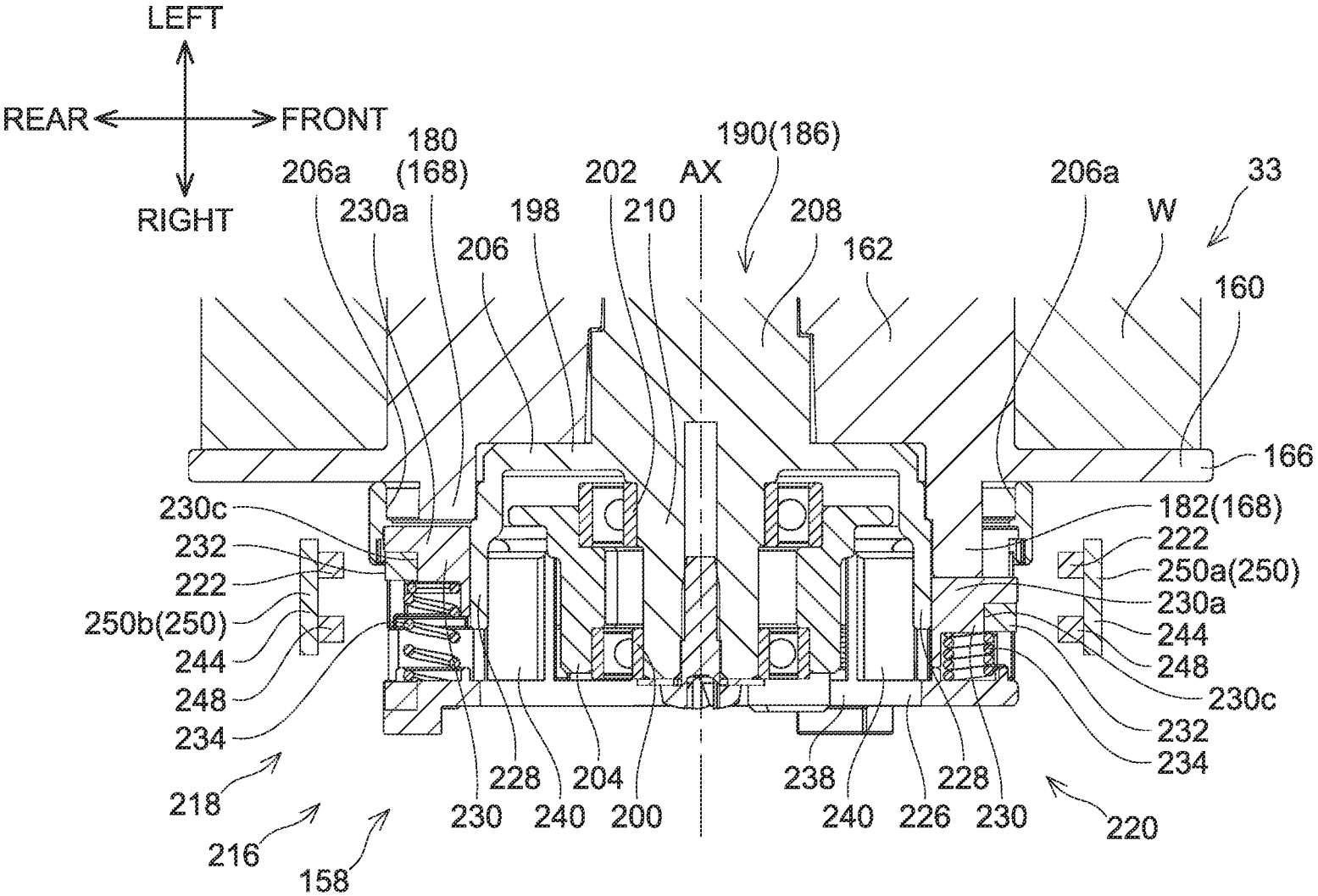
FIG. 27 is a cross-sectional view of a reel 33, the type detecting mechanism 158, and the right reel attaching part 190 according to the first embodiment.

As shown in FIG. 27, as the reel 33 is attached to the reel attaching part 186, the three long projections 182 push corresponding movable members 230 to an attaching position from the initial position. In the direction along the rotation axis AX of the reel 33, the attaching position is closer to the base 238 of the cover member 226 than the initial position is. The attaching position may vary depending on types of reels 33. As the movable members 230 are pushed to the attaching position, the type-detecting magnets 232 are also pushed. In the state where the movable members 230 are at the attaching position, the type-detecting magnets 232 are at positions that face the rotation-detecting magnetic sensors 248 as the reel 33 rotates (see the front movable member 230 in FIG. 27). Contrary to this, since the length of the short projections 180 is shorter than the length of the long projections 182, the three short projections 180 do not contact corresponding movable members 230 even when the reel 33 is attached to the reel attaching part 186. These movable members 230 are not pushed by the short projections 180 and thus maintained at the initial position by the biasing force of the compression springs 234. In the state where the movable members 230 are at the initial position, the type-detecting magnets 232 are at positions that face the type-detecting magnetic sensor 222 as the reel 33 rotates (see the rear movable member 230 in FIG. 27).

Next, the control circuit board 36 (see FIG. 3) executes a type detecting process for detecting the type of the reel 33. The control circuit board 36 executes the type detecting process in response to detecting that the main cover 28 is in the closed state via a closed state detecting sensor (not shown) attached to the holder housing 26. The type detecting process is executed, for example, when the reel 33 is attached to the reel holder 10 of a newly purchased rebar tying tool 2 and/or when a new reel 33 is attached to the reel holder 10 in replacement of the used reel 33. The type detecting process is different from the tying operation of tying the rebars R with the wire W.

Figure 28:
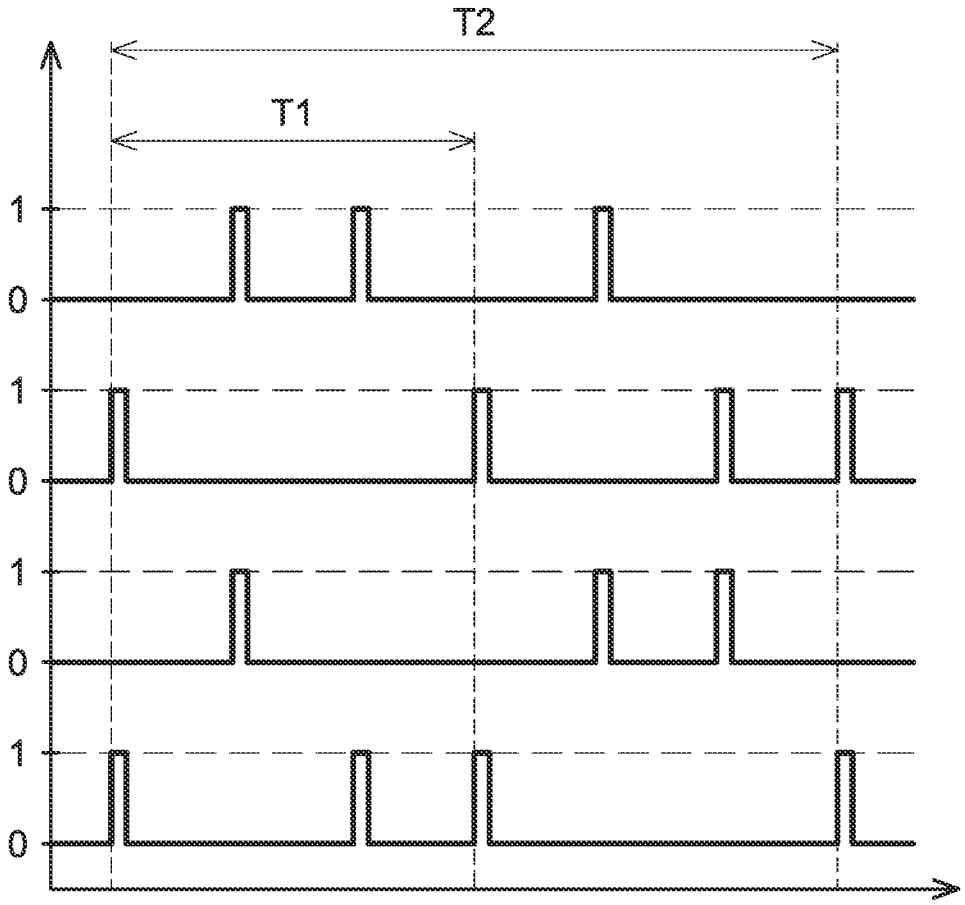
FIG. 28 illustrates signal charts detected by type-detecting magnetic sensors 222 and rotation-detecting magnetic sensors 248 according to the first embodiment.

When the control circuit board 36 rotates the feeding motor 50 (see FIG. 4) forward (in the direction D1 in FIG. 4), the reel 33 thereby rotates. With the rotation of the reel 33, the type detecting device 220 integrally rotates with the turntable 198. Every time the movable members 230 at the initial position pass positions facing the type-detecting magnetic sensors 222, the type-detecting magnetic sensors 222 detect the type-detecting magnets 232, for example, by detecting magnetic variations. The control circuit board 36 detects that the type-detecting magnets 232 were detected. Further, every time the movable members 230 at the attaching position pass positions facing the rotation-detecting magnetic sensors 248, the rotation-detecting magnetic sensors 248 detect the type-detecting magnets 232, for example, by detecting magnetic variations. The control circuit board 36 detects that the type-detecting magnets 232 were detected. The control circuit board 36 detects signal charts shown in FIG. 28 as the reel 33 rotates. In FIG. 28, the top signal chart depicted with a solid line is a signal chart associated with the detection by the type-detecting magnetic sensor 222 of the detector 250*a*, the second signal chart from the top depicted with a solid line is a signal chart associated with the detection by the rotation-detecting magnetic sensor 248 of the detector 250*a*, the third signal chart from the top depicted with a solid line is a signal chart associated with the detection by the type-detecting magnetic sensor 222 of the detector 250*b*, and the fourth signal chart from the top (the bottom signal chart) depicted with a solid line is a signal chart associates with the detection by the rotation-detecting magnetic sensor 248 of the detector 250*b*. In the example of FIG. 28, signal strength indicates "1" for when the type-detecting magnetic sensors 222 detect the type-detecting magnets 232 and when the rotation-detecting magnetic sensors 248 detect the type-detecting magnets 232, whereas the signal strength indicates "0" for when the type-detecting magnetic sensors 222 do not detect the type-detecting magnets 232 and when the rotation-detecting magnetic sensors 248 do not detect the type-detecting magnets 232.

Upon when the signal strength "1" takes place sixth times after the signal strength "1" took place for the first time in the four signal charts, the control circuit board 36 determines that the reel 33 has made a ½ turn and stops the feeding motor 50. The control circuit board 36 determines that the feeding motor 50 stops when the number of rotations of the feeding motor 50 is decreased to or less than a predetermined number of rotations (e.g., 0). The signal strength "1" taking place six times after the signal strength "1" took place for the first time means that all of the type-detecting magnets 232 have been detected by the type-detecting magnetic sensor 222 and the rotation-detecting magnetic sensor 248 of the detector 250*a* or the type-detecting magnetic sensor 222 and the rotation-detecting magnetic sensor 248 of the detector 250*b*. Then, the control circuit board 36 specifies shapes of the four signal charts detected within a time period T1 in FIG. 28. The time period T1 is a half of a time period T2 of signal charts for when the reel 33 has rotated once. The control circuit board 36 then specifies reference signal charts that match the specified shapes of the four signal charts. Since the movable members 230 pushed to the attaching position varies depending on types of reels 33, the shapes of the reference signal charts vary depending on types of reels 33. The control circuit board 36 stores a plurality of reference signal charts corresponding to types of reels 33. The control circuit board 36 specifies the type of the reel 33 based on the specified reference signal charts. Then, the control circuit board 36 sets conditions for tying the rebars R with the wire W using the rebar tying tool 2 according to the specified type of the reel 33. Finally, the control circuit board 36 rotates the feeding motor 50 in reverse (in the direction D2 in FIG. 4) to pull back the wire W toward the reel 33.

(Effects)

The rebar tying tool 2 comprises the reel 33 comprising the bobbin 160 and the wire W wound around the bobbin 160, wherein the bobbin 160 comprises the long projections 182; the reel attaching part 186 to which the reel 33 is rotatably attached; the feeding unit 38 configured to feed the wire W from the bobbin 160 around the rebars R; the twisting unit 46 configured to twist the wire W around the rebars R; the plurality of detectors 250 configured to detect the long projections 182; and the support 15 supporting the reel attaching part 186, the feeding unit 38, the twisting unit 46, and the plurality of detectors 250. The plurality of detectors 250 is disposed along the rotation direction of the reel 33 and configured to detect the long projections 182 as the reel 33 rotates.

According to the configuration above, the plurality of detectors 250 is disposed along the rotation direction of the reel 33, and thus the long projections 182 can be detected before the reel 33 finishes rotating once. Thus, specific information of the reel 33 can be detected before the reel 33 finishes rotating once.

Further, the rebar tying tool 2 comprises the reel attaching part 186 to which the reel 33 is rotatably attached, wherein the reel 33 comprises the bobbin 160 including the long projections 182 and the wire W wound around the bobbin 160; the feeding unit 38 configured to feed the wire W from the bobbin 160 around the rebars R; the twisting unit 46 configured to twist the wire W around the rebars R; the plurality of detectors 250 configured to detect the long projections 182; and the support 15 supporting the reel attaching part 186, the feeding unit 38, the twisting unit 46, and the plurality of detectors 250. The plurality of detectors 250 is disposed along the rotation direction of the reel 33 and configured to detect the long projections 182 as the reel 33 rotates.

The configuration above can achieve the same effects as those of the rebar tying tool above.

The reel 33 disclosed herein is used by being rotatably attached to the reel attaching part 186 of the rebar tying tool 2. The reel 33 comprises the bobbin 160 comprising the long projections 182 and the wire W wound around the bobbin 160. The rebar tying tool 2 comprises the plurality of detectors 250 disposed along the rotation direction of the reel 33. The long projections 182 include type information that indicates the type of the reel 33. The long projections 182 are detected by the plurality of detectors 250 as the reel 33 rotates.

According to the configuration above, the plurality of detectors 250 is disposed along the rotation direction of the reel 33, and as such, after the reel 33 is attached to the reel attaching part 186 of the rebar tying tool 2, the long projections 182 are detected before the reel 33 finishes rotating once. Thus, the configuration can cause the rebar tying tool 2 to detect specific information of the reel 33 before the reel 33 finishes rotating once.

Further, the reel attaching part 186 comprises the turntable 198 rotatably supported by the support 15. The bobbin 160 is fixed to the turntable 198 when the reel 33 is attached to the reel attaching part 186.

According to the configuration above, since the turntable 198 is supported by the support 15, there is no need to attach/detach the turntable 198 to/from the support 15. Thus, displacement of the rotation axis of the turntable 198 can be suppressed. Displacement of the rotation axis AX of the reel 33 thus can be suppressed.

Moreover, the rebar tying tool 2 further comprises the movable members 230 movably supported by the turntable 198. The movable members 230 are at the initial position when the reel 33 is not attached to the reel attaching part 186. The long projections 182 push the movable members 230 toward the attaching position when the reel 33 is attached to the reel attaching part 186. Each of the plurality of detectors 250 is configured to detect the long projections 182 by detecting the movable members 230 at the attaching position.

According to the configuration above, specific information of the reel 33 can be detected with a simple configuration of detecting the position of the movable members 230, before the reel 33 finishes rotating once.

Moreover, the rebar tying tool 2 further comprises the type-detecting magnets 232 fixed to the movable members 230. Each of the plurality of detectors 250 comprises the type-detecting magnetic sensor 222 configured to detect whether the movable members 230 are at the attaching position by detecting the type-detecting magnets 232.

In case of using an optical sensor, for example, a photointerrupter, the detection sensitivity of the photointerrupter may be decreased if the photointerrupter is contaminated by a foreign matter, etc. or if the photointerrupter is exposed to scattering light. According to the configuration above, the type-detecting magnetic sensors 222 detect whether the movable members 230 are at the attaching position or not, for example, by detecting magnetic variations caused by the type-detecting magnets 232. Whether the movable members 230 are at the attaching position or not can be detected without the influence of contamination by foreign matters and scattering light, as compared to using a photointerrupter.

Moreover, the rebar tying tool 2 further comprises the compression springs 234 configured to bias the movable members 230 toward the initial position when the reel 33 is detached from the reel attaching part 186.

According to the configuration above, the movable members 230 can be returned to the initial position when the reel 33 is detached from the reel attaching part 186.

Moreover, the bobbin 160 comprises the trunk 162 around which the wire W is wound and the flange 166 disposed at one end of the trunk 162. The long projections 182 project outward beyond the outer surface of the flange 166 along the rotation axis AX of the reel 33. The turntable 198 comprises the receivers **206*a* configured to receive and engage with the long projections 182**.

According to the configuration above, the reel 33 can be fixed to the turntable 198 with a simple configuration.

Further, each of the plurality of detectors 250 comprises the rotation detecting unit 218 configured to detect a rotation angle of the reel 33.

According to the configuration above, the detectors 250 can be used to detect not only the type of the reel 33 but also the rotation of the reel 33.

Moreover, the rebar tying tool 2 further comprises the rotation-detecting magnets 232 configured to integrally rotate with the reel 33. Each rotation detecting unit 218 comprises the rotation-detecting magnetic sensor 248 configured to detect the rotation angle of the reel 33 by detecting the rotation-detecting magnets 232.

In case of using an optical sensor, for example, a photointerrupter, the detection sensitivity may be decreased if the photointerrupter is contaminated by a foreign matter, etc. or if the photointerrupter is exposed to scattering light. According to the configuration above, the rotation-detecting magnetic sensors 248 detect the rotation angle of the reel 33, for example, by detecting magnetic variations caused by the type-detecting magnets 232. The rotation angle of the reel 33 can be detected without the influence of contamination by foreign matters and scattering light, as compared to using a photointerrupter.

Further, the plurality of detectors 250 is fixed to the support 15.

According to the configuration above, the position of the plurality of detectors 250 does not change even when the reel 33 rotates. Thus, the long projections 182 can be detected accurately by the plurality of detectors 250.

Further, the plurality of detectors 250 comprises two detectors 250. The detectors 250 adjacent to each other is disposed along the rotation direction at intervals corresponding to an angle of 180 degrees (360 degrees/2).

According to the configuration above, specific information of the reel 33 can be detected by the reel 33 rotating by the angle of 180 degrees (360 degrees/2).

(Correspondence Relationships)

The long projections 182 are examples of "detection target portion" and "projection". The compression springs 234 is an example of "biasing member". The rotation detecting units 218 are an example of "rotation detector". The type-detecting magnets 232 are an example of "rotation-detecting magnet".

Second Embodiment

Figure 29:
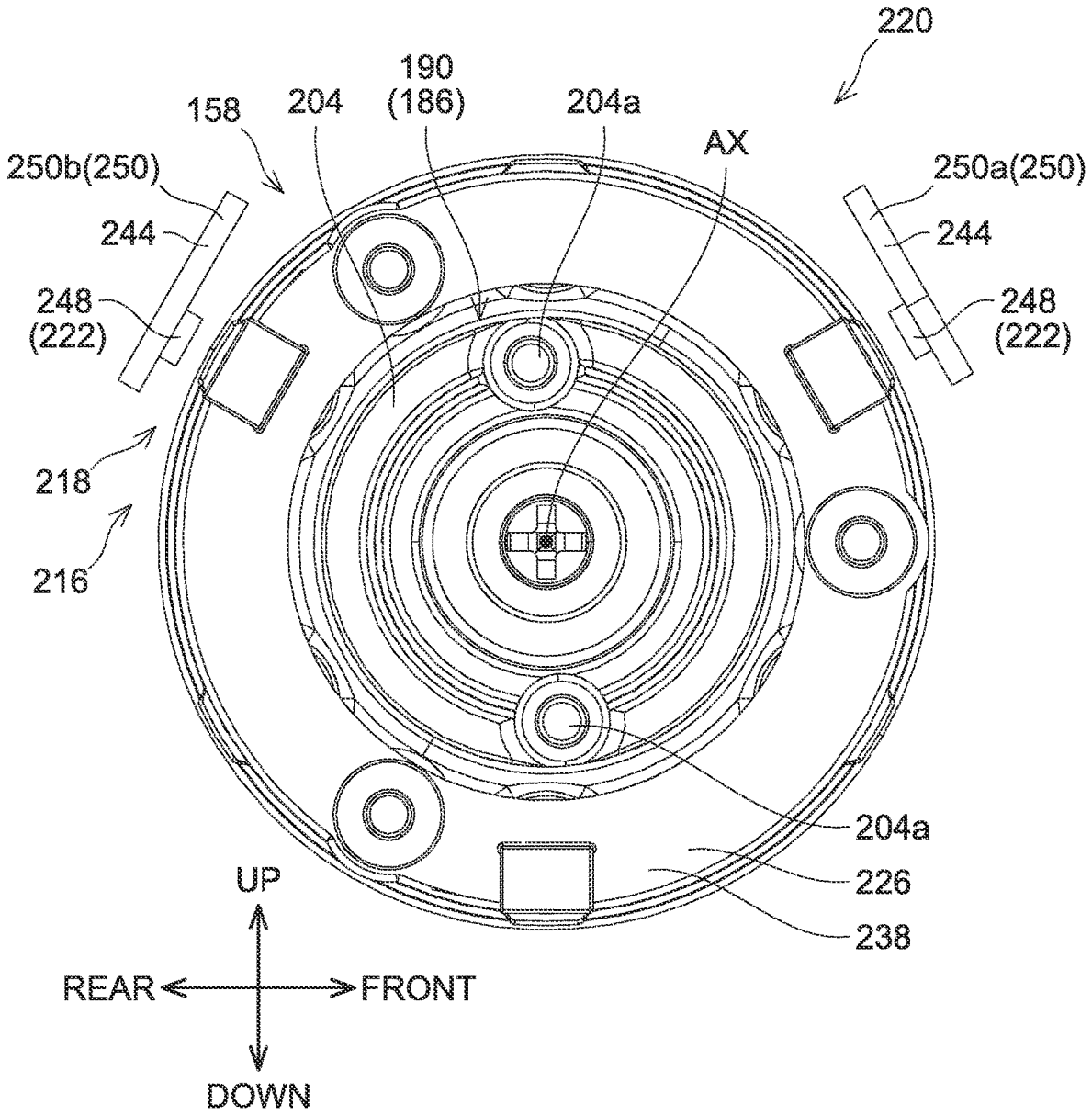
FIG. 29 is a right side view of a type detecting mechanism 158 and a right reel attaching part 190 according to a second embodiment.

Referring to the drawings, a second embodiment will be described. For the second embodiment, only differences from the first embodiment will be described, and like/same elements from the first embodiment will be labeled with like/same reference signs and description for them will be omitted. As shown in FIG. 29, in the second embodiment, two type-detecting magnetic sensors 222 are not disposed at regular intervals along the rotation direction of a reel 33 (see FIG. 18) (around a rotation axis AX of the reel 33) and two rotation-detecting magnetic sensors 248 are not disposed at regular intervals along the rotation direction of the reel 33, either.

The two type-detecting magnetic sensors 222 are disposed with an interval corresponding to an angle of 240 degrees therebetween along the rotation direction of the reel 33. That is, the two type-detecting magnetic sensors 222 are disposed with an interval corresponding to an angle of 120 degrees therebetween along an opposite direction to the rotation direction of the reel 33. The two rotation-detecting magnetic sensors 248 are disposed with an interval corresponding to an angle of 240 degrees therebetween along the rotation direction of the reel 33. That is, the two rotation-detecting magnetic sensors 248 are disposed with an interval corresponding to an angle of 120 degrees therebetween along the opposite direction to the rotation direction of the reel 33.

Figure 30:
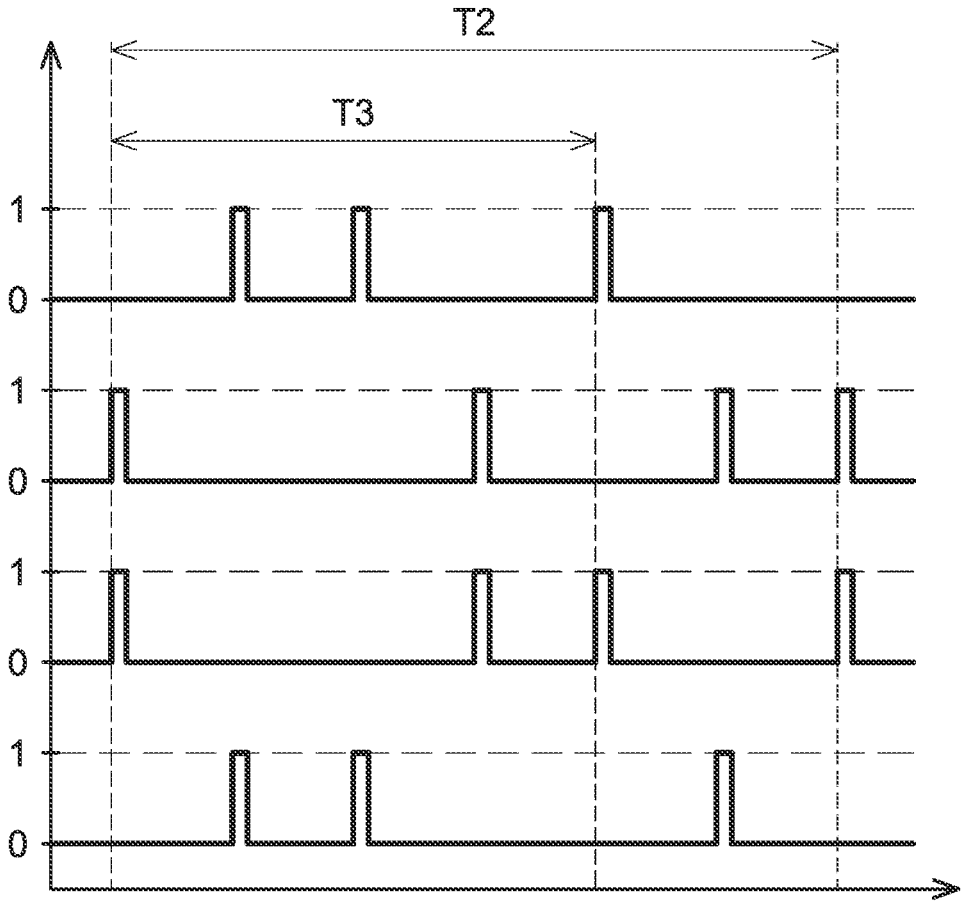
FIG. 30 illustrates signal charts detected by type-detecting magnetic sensors 222 and rotation-detecting magnetic sensors 248 according to the second embodiment.

A method of detecting the type of the reel 33 will be described. Hereinafter, only a type detecting process will be described. Upon when the signal strength "1" takes place eight times after the signal strength "1" took place for the first time in the four signal charts shown in FIG. 30, a control circuit board 36 determines that the reel 33 has made a ⅔ turn and stops a feeding motor 50 (see FIG. 4). The control circuit board 36 determines that the feeding motor 50 stops when the number of rotations of the feeding motor 50 is decreased to or less than a predetermined number of rotations (e.g., 0). The signal strength "1" taking place eight times after the signal strength "1" took place for the first time means that all of type-detecting magnets 232 have been detected by the type-detecting magnetic sensor 222 and the rotation-detecting magnetic sensor 248 of a detector 250*a* or the type-detecting magnetic sensor 222 and the rotation-detecting magnetic sensor 248 of a detector 250*b*. Then, the control circuit board 36 specifies shapes of the four signal charts detected within a time period T3 in FIG. 30. The time period T3 is ⅔ of the time period T2 of signal charts for when the reel 33 has rotated once. The control circuit board 36 then specifies reference signal charts that match the specified shapes of the four signal charts. Since the movable members 230 pushed to the attaching position varies depending on types of reels 33, the shapes of the reference signal charts vary depending on types of reels 33. The control circuit board 36 stores a plurality of reference signal charts corresponding to types of reels 33. The control circuit board 36 specifies the type of the reel 33 based on the specified reference signal charts. Then, the control circuit board 36 sets conditions for tying the rebars R with the wire W using the rebar tying tool 2 according to the specified type of the reel 33. Finally, the control circuit board 36 rotates the feeding motor 50 in reverse (in the direction D2 in FIG. 4) to pull hack the wire W toward the reel 33.

(Effects)

The plurality of detectors 250 comprises two detectors 250. The maximum interval between the detectors 250 adjacent to each other may be an interval corresponding to a specific angle (240 degrees) that is greater than 180 degrees (360 degrees/2) along the rotation direction.

According to the configuration above, specific information of the reel 33 can be detected by the reel 33 rotating by the specific angle (240 degrees) that is smaller than 360 degrees.

Third Embodiment

Figure 31:
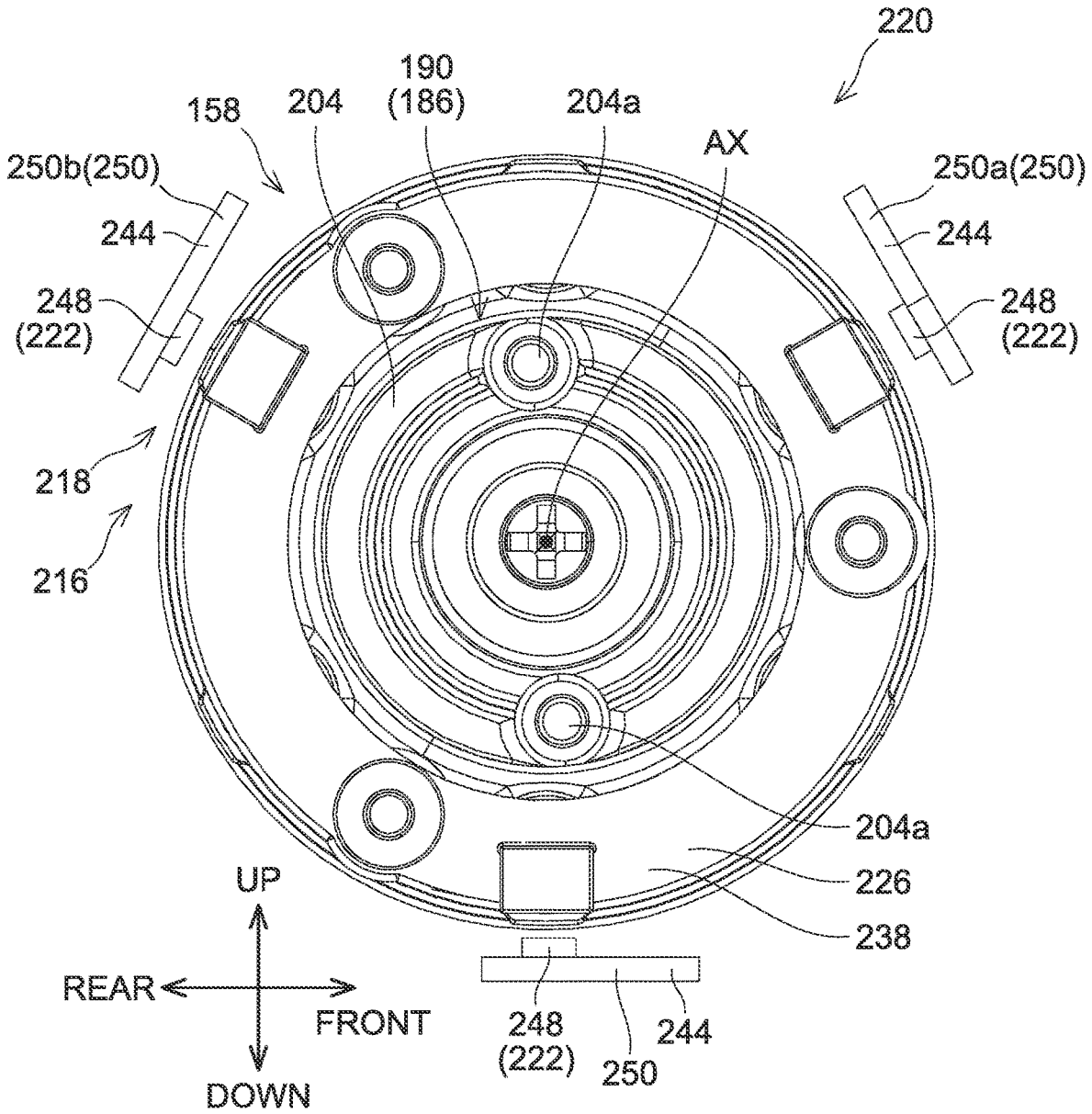
FIG. 31 is a right side view of a type detecting mechanism 158 and a right reel attaching part 190 according to a third embodiment.

Referring to the drawings, a third embodiment will be described. For the third embodiment, only differences from the first embodiment will be described, and like/same elements from the first embodiment will be labeled with like/same reference signs and description for them will be omitted. As shown in FIG. 31, in the third embodiment, a type detecting mechanism 158 comprises three detectors 250. Three type-detecting magnetic sensors 222 are disposed at regular intervals along the rotation direction of a reel 33 (see FIG. 18) (around a rotation axis AX of the reel 33). In the present embodiment, the three type-detecting magnetic sensors 222 are disposed at intervals corresponding to an angle of 120 degrees (360 degrees/three sensors) along the rotation direction of the reel 33. Three rotation-detecting magnetic sensors 248 are also disposed at regular intervals along the rotation direction of the reel 33. In the present embodiment, the three rotation-detecting magnetic sensors 248 are disposed at intervals corresponding to an angle of 120 degrees (360 degrees/three sensors) along the rotation direction of the reel 33.

In the third embodiment, as the reel 33 makes a ⅓ turn, all of type-detecting magnets 232 (see FIG. 27) are detected by the type-detecting magnetic sensors 222 or the rotation-detecting magnetic sensors 248. When determining that the reel 33 has made a ⅓ turn, a control circuit board 36 (see FIG. 3) specifies the type of the reel 33 by using shapes of signal charts.

(Variants)

In one embodiment, the rotation detecting unit 218 may further comprise a plurality of rotation-detecting magnets. The rotation-detecting magnets may be fixed to the cover member 226 of the type detecting device 220. In this instance, the rotation-detecting magnetic sensors 248 may be disposed at positions that face the rotation-detecting magnets as the reel 33 rotates.

In one embodiment, the number of the projections 168 is not limited to six but may be any number. Further, the number of the short projections 180 and the number of the long projections 182 are not limited to three but may be any numbers.

In one embodiment, the projections 168 may not be disposed at regular intervals around the rotation axis AX of the reel 33.

In one embodiment, the number of the detectors 250 is not limited to two or three but may be four or more.

What is claimed is:

1. A rebar tying tool comprising:

a reel attaching part to which a reel is rotatably attached, wherein the reel comprises a bobbin including a detection target portion and a wire wound around the bobbin;

a feeding unit configured to feed the wire from the bobbin around rebars;

a twisting unit configured to twist the wire around the rebars;

a plurality of detectors configured to detect the detection target portion; and a support supporting the reel attaching part, the feeding unit, the twisting unit, and the plurality of detectors, wherein the plurality of detectors is disposed along a rotation direction of the reel and configured to detect the detection target portion as the reel rotates, the rebar tying tool further comprises a movable member movably supported by the support, the detection target portion comprises a projection, the movable member is at an initial position when the reel is not attached to the reel attaching part, the projection is configured to push the movable member toward an attaching position when the reel is attached to the reel attaching part, and each of the plurality of detectors is configured to detect the detection target portion by detecting the movable member at the attaching position.

2. The rebar tying tool according to claim 1, further comprising a type-detecting magnet, wherein a position of the type-detecting magnet is fixed to the movable member, and each of the plurality of detectors comprises a type-detecting magnetic sensor configured to detect whether the movable member is at the attaching position by detecting the type-detecting magnet.

3. The rebar tying tool according to claim 1, further comprising a biasing member configured to bias the movable member toward the initial position when the reel is detached from the reel attaching part.

4. The rebar tying tool according to claim 1, wherein the bobbin comprises:

a trunk around which the wire is wound; and a flange disposed at one end of the trunk, the projection projects along a rotation axis of the reel, and the reel attaching part comprises a receiver configured to receive the projection.

5. The rebar tying tool according to claim 1, wherein each of the plurality of detectors comprises a rotation detector configured to detect a rotation angle of the reel.

6. The rebar tying tool according to claim 5, further comprising a rotation-detecting magnet configured to integrally rotate with the reel, wherein each rotation detector comprises a rotation-detecting magnetic sensor configured to detect the rotation angle of the reel by detecting the rotation-detecting magnet.

7. The rebar tying tool according to claim 1, wherein each position of the plurality of detectors is fixed to the support.

8. The rebar tying tool according to claim 1, wherein the plurality of detectors comprises N detectors, wherein the N is an integer greater than or equal to 2, and the detectors adjacent to each other are disposed along the rotation direction at intervals corresponding to an angle of 360/N degrees.

9. The rebar tying tool according to claim 6, wherein the plurality of detectors comprises N detectors, wherein the N is an integer greater than or equal to 2, and the detectors adjacent to each other are disposed along the rotation direction at intervals corresponding to an angle of 360/N degrees.

10. The rebar tying tool according to claim 1, wherein the plurality of detectors comprises N detectors, wherein the N is an integer greater than or equal to 2, and a maximum interval between the detectors adjacent to each other is an interval corresponding to a specific angle that is greater than an angle of 360/N degrees along the rotation direction.

11. The rebar tying tool according to claim 1, further comprising the reel.

12. A rebar tying tool comprising:

a reel attaching part to which a reel is rotatably attached, wherein the reel comprises a bobbin including a detection target portion and a wire wound around the bobbin;

a feeding unit configured to feed the wire from the bobbin around rebars;

a twisting unit configured to twist the wire around the rebars;

a plurality of detectors configured to detect the detection target portion; and a support supporting the reel attaching part, the feeding unit, the twisting unit, and the plurality of detectors, wherein the plurality of detectors is disposed along a rotation direction of the reel and configured to detect the detection target portion as the reel rotates, each of the plurality of detectors comprises a rotation detector configured to detect a rotation angle of the reel, the rebar tying tool further comprises a rotation-detecting magnet configured to integrally rotate with the reel, and each rotation detector comprises a rotation-detecting magnetic sensor configured to detect the rotation angle of the reel by detecting the rotation-detecting magnet.

13. The rebar tying tool according to claim 12, wherein each position of the plurality of detectors is fixed to the support.

14. The rebar tying tool according to claim 12, wherein the plurality of detectors comprises N detectors, wherein the N is an integer greater than or equal to 2, and the detectors adjacent to each other are disposed along the rotation direction at intervals corresponding to an angle of 360/N degrees.

15. The rebar tying tool according to claim 12, wherein the plurality of detectors comprises N detectors, wherein the N is an integer greater than or equal to 2, and a maximum interval between the detectors adjacent to each other is an interval corresponding to a specific angle that is greater than an angle of 360/N degrees along the rotation direction.

16. The rebar tying tool according to claim 12, further comprising the reel.

17. A rebar tying tool comprising:

a reel attaching part to which a reel is rotatably attached, wherein the reel comprises a bobbin including a detection target portion and a wire wound around the bobbin;

a feeding unit configured to feed the wire from the bobbin around rebars;

a twisting unit configured to twist the wire around the rebars;

a plurality of detectors configured to detect the detection target portion; and a support supporting the reel attaching part, the feeding unit, the twisting unit, and the plurality of detectors, wherein the plurality of detectors is disposed along a rotation direction of the reel and configured to detect the detection target portion as the reel rotates, the plurality of detectors comprises N detectors, wherein the N is an integer greater than or equal to 2, and the detectors adjacent to each other are disposed along the rotation direction at intervals corresponding to an angle of 360/N degrees.

18. The rebar tying tool according to claim 17, wherein each position of the plurality of detectors is fixed to the support.

19. The rebar tying tool according to claim 17, further comprising the reel.

* * * * *